US012428869B2

(12) United States Patent
Luczycki et al.

(10) Patent No.: US 12,428,869 B2
(45) Date of Patent: Sep. 30, 2025

(54) SECURITY FENCE

(71) Applicant: Fortress Iron, LP, Garland, TX (US)

(72) Inventors: Geoff T. Luczycki, Garland, TX (US); Kevin T. Burt, Dallas, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 17/982,588

(22) Filed: Nov. 8, 2022

(65) Prior Publication Data

US 2023/0061630 A1 Mar. 2, 2023

Related U.S. Application Data

(63) Continuation of application No. 16/654,493, filed on Oct. 16, 2019, now Pat. No. 11,499,336.

(51) Int. Cl.

| | |
|---|---|
| ***E04H 17/14*** | (2006.01) |
| ***E04H 17/20*** | (2006.01) |
| ***E04H 17/24*** | (2006.01) |

(52) U.S. Cl.

CPC ..... *E04H 17/1439* (2013.01); *E04H 17/1447* (2021.01); *E04H 17/24* (2013.01); *E04H 17/1452* (2021.01)

(58) Field of Classification Search

CPC ..... E04H 17/1439; E04H 17/1448; E04H 17/1465

(Continued)

(56) References Cited

U.S. PATENT DOCUMENTS 24,373 A * 6/1859 Cadwell ..... E04H 17/1413 256/65.02
346,644 A * 8/1886 Crisp ..... E04H 17/1447 256/22

(Continued)

FOREIGN PATENT DOCUMENTS

FR 2334810 A1 7/1977
FR 2780432 A1 12/1999

(Continued)

OTHER PUBLICATIONS

International Search Report and Written Opinion on International Application No. PCT/US2020/055684, mail date Jan. 21, 2021, 9 pages.

(Continued)

*Primary Examiner* — Joshua T Kennedy
(74) *Attorney, Agent, or Firm* — Foley & Lardner LLP; John J. May

(57) ABSTRACT

A security fence includes a pair of posts and a plurality of rails supported by the pair of posts and disposed vertically spaced apart. Each rail includes a bottom wall and an upper wall, each defining a plurality of spaced apart openings. A plurality of pickets are horizontally spaced apart along the plurality of rails, each picket extends through a respective bottom opening and a respective upper opening of each rail. A slide lock bar is disposed within at least one of the plurality of rails and is supported by the bottom wall of the one of the plurality of rails. The slide lock bar traverses the plurality of pickets and is received by a notch in each picket. Engagement of the slide lock bar with the notches enables angular displacement of each picket with respect to each rail.

19 Claims, 19 Drawing Sheets

(58) Field of Classification Search
USPC ..... 256/65.03, 65.02, 65.08
See application file for complete search history.

(56) References Cited

U.S. PATENT DOCUMENTS 1,911,087 A * 5/1933 Rasmussen ..... E04H 17/124 256/48
1,956,767 A 5/1934 Kibler
1,970,737 A 8/1934 Cole
2,919,113 A 12/1959 Cofield
3,225,501 A 12/1965 McCaron
3,397,866 A 8/1968 Hockett
3,604,686 A 9/1971 Parisien
3,879,017 A 4/1975 Maxcy et al.
4,075,473 A 2/1978 Winston
4,360,285 A 11/1982 Magness
4,576,507 A 3/1986 Terio
4,690,440 A 9/1987 Rogers
4,723,760 A 2/1988 O'Sullivan
4,780,020 A 10/1988 Terio
4,809,955 A 3/1989 Veilleux
4,858,383 A 8/1989 Kendig
4,871,203 A 10/1989 Rogers
4,964,618 A 10/1990 Kennedy et al.
4,979,817 A 12/1990 Crisp, Sr.
4,989,835 A 2/1991 Hirsh
5,136,813 A 8/1992 Gibbs et al.
5,167,049 A 12/1992 Gibbs
5,272,838 A 12/1993 Gibbs
5,275,382 A 1/1994 Charbaut et al.
5,345,723 A 9/1994 Gibbs
5,443,244 A 8/1995 Gibbs
5,702,090 A 12/1997 Edgman
6,041,486 A 3/2000 Forbis
6,173,944 B1 1/2001 McCarthy
6,176,043 B1 1/2001 Gibbs
6,254,064 B1 7/2001 Gibbs
D465,856 S 11/2002 Givens et al.
D466,620 S 12/2002 Givens et al.
D467,669 S 12/2002 Givens et al.
D468,028 S 12/2002 Givens et al.
6,672,569 B2 * 1/2004 Deeley ..... E04H 17/143 256/65.01
6,684,477 B2 2/2004 Crissey
6,739,583 B2 5/2004 Ryon
6,752,386 B1 * 6/2004 Bundy ..... E04H 17/1439 256/22
D495,434 S 8/2004 Cooper
6,796,549 B1 9/2004 Lester
6,811,145 B2 11/2004 Gibbs et al.
6,824,123 B2 11/2004 Larsen et al.
6,874,765 B2 4/2005 Deeley
6,874,767 B1 * 4/2005 Gibbs ..... E04H 17/143 256/65.02
6,883,786 B2 4/2005 Bebendorf
6,969,051 B1 11/2005 Gibbs
7,071,439 B2 7/2006 Gibbs et al.
7,086,642 B1 8/2006 O'Brien
7,090,202 B1 8/2006 O'Brien
D534,792 S 1/2007 Cooper
7,159,853 B2 1/2007 Gibbs et al.
7,188,826 B1 3/2007 Gibbs
7,282,659 B1 10/2007 Gibbs et al.
7,325,787 B1 2/2008 Gibbs
D566,292 S 4/2008 Gibbs
D572,374 S 7/2008 Gibbs
D573,270 S 7/2008 Gibbs
7,396,002 B1 * 7/2008 Gibbs ..... E04H 17/143 256/67
7,441,751 B1 10/2008 Gibbs
7,461,833 B1 12/2008 Gibbs
7,475,868 B1 * 1/2009 Gibbs ..... E01F 15/06 256/34
7,500,655 B1 3/2009 Smith et al.
7,621,510 B2 11/2009 Gibbs et al.
7,651,073 B1 1/2010 Gibbs
D609,551 S 2/2010 Gibbs
7,661,656 B1 2/2010 Gibbs et al.
D620,128 S 7/2010 Gibbs
D622,870 S 8/2010 Gibbs
7,896,318 B1 3/2011 Gibbs et al.
7,942,384 B1 5/2011 Gibbs
7,980,534 B1 7/2011 Gibbs et al.
D655,826 S 3/2012 Gibbs
8,382,070 B1 * 2/2013 Gibbs ..... E04H 17/143 256/65.02
8,403,303 B2 3/2013 Payne et al.
8,413,332 B2 4/2013 Duffy et al.
8,413,965 B2 4/2013 Duffy et al.
8,523,150 B2 9/2013 Gibbs et al.
8,720,866 B1 5/2014 Gibbs
8,887,370 B2 11/2014 Payne et al.
9,151,075 B2 10/2015 Duffy et al.
9,551,164 B2 1/2017 Duffy et al.
9,840,854 B1 12/2017 Gibbs et al.
9,963,905 B2 5/2018 Duffy et al.
D826,427 S 8/2018 Filiba
D828,579 S 9/2018 Saltijeral
D836,799 S 12/2018 Flusche et al.
10,533,340 B1 1/2020 Ohanesian
D899,626 S 10/2020 Muc
D927,731 S * 8/2021 Luczycki ..... D25/42
2002/0000545 A1 1/2002 Pettit et al.
2003/0197163 A1 10/2003 Deeley
2003/0209700 A1 11/2003 Gibbs
2005/0040382 A1 2/2005 Gibbs et al.
2005/0092978 A1 5/2005 Gibbs et al.
2005/0199864 A1 9/2005 Gibbs et al.
2008/0237561 A1 10/2008 Cozby
2009/0026431 A1 * 1/2009 Tremblay ..... E04H 17/1447 256/22
2010/0288988 A2 11/2010 Gibbs et al.
2012/0286224 A1 * 11/2012 Duffy ..... E04H 17/1439 256/22
2023/0123821 A1 * 4/2023 Messelis ..... E04H 17/1439 256/24

FOREIGN PATENT DOCUMENTS

GB 0 897 247 A 5/1962
GB 2 594 660 A 11/2021
WO WO-2004/048720 A2 6/2004
WO WO-2010094081 A1 * 8/2010 ..... E04H 17/1443
WO WO-2010/121789 A2 10/2010
WO WO-2014/057278 4/2014

OTHER PUBLICATIONS

Extended European Search Report for European Patent Application No. EP 20876053.8 dated Sep. 20, 2023.

* cited by examiner

SECURITY FENCE

CROSS-REFERENCE TO RELATED PATENT APPLICATIONS

This application is a continuation of U.S. patent application Ser. No. 16/654,493, filed on Oct. 16, 2019, the disclosure of which is hereby incorporated by reference.

BACKGROUND OF THE INVENTION

Technical Field of the Invention

The present invention relates generally to a security fence, and more particularly to a security fence with an adjustable rake angle between vertical pickets or pales extending through a plurality of rails.

Description of Related Art

Heavy duty security fences are used to protect property from unwanted trespass or intrusion. The property may be a high risk target for terrorists or other criminals. For example, a power plant or oil refinery may be protected with a heavy duty security fence. Vehicles may be packed with explosives and driven at a high rate of speed in an attempt to breach the security fence and damages or otherwise disrupt operations occurring on the property that is protected by a security fence. Reinforcing cables may be used to reinforce a steel security fence. A braided steel cable may withstand and even stop a vehicle from being driven through a security fence. Security fences are often built custom to the protected property. As such, individual pickets may be secured to a face of the security fence at an angle with respect to the rails to follow a slope in the terrain.

Security fences employing the raking (also referred to as racking) technology disclosed and claimed in U.S. Pat. No. 6,752,386 filed on May 13, 2003 and issued to Bundy with square cross section pickets are currently in use. However, it is desirable to construct security fences that are stronger, for example it is desirable to construct a raking fence that can better withstand an attempt by a moving vehicle to breach the security fence.

SUMMARY

In accordance with an embodiment, a security fence includes a pair of posts and a plurality of rails supported by the pair of posts and disposed vertically spaced apart. Each rail includes a bottom wall and an upper wall, each wall defining a plurality of spaced apart openings. A plurality of pickets are horizontally spaced apart along the plurality of rails, each picket extends through a respective bottom opening and a respective upper opening of each rail. A slide lock bar is disposed within at least one of the plurality of rails and is supported by the bottom wall of the one of the plurality of rails. The slide lock bar traverses the plurality of pickets and is received by a notch in each picket. Engagement of the slide lock bar with the notches enables angular displacement of each picket with respect to each rail.

The present disclosure discloses a security fence with pickets or pales that extend through rails. Raking or positioning the rails in a non-perpendicular angle while maintaining generally vertical pickets is facilitated by the slide lock bar assembly that partially secures the pickets or pales with respect to the plurality of rails.

According to one embodiment, the rails are adjustable through a rake angle of +/−10 degrees with respect to the posts. The pickets may have a W-shaped or D-shaped cross section.

Technical advantages of a security fence according to the present disclosure include fence panels that are easily rackable to follow a sloping or uneven terrain while the rails of the security fence are able to hold a reinforcing cable to increase the strength of the fence.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
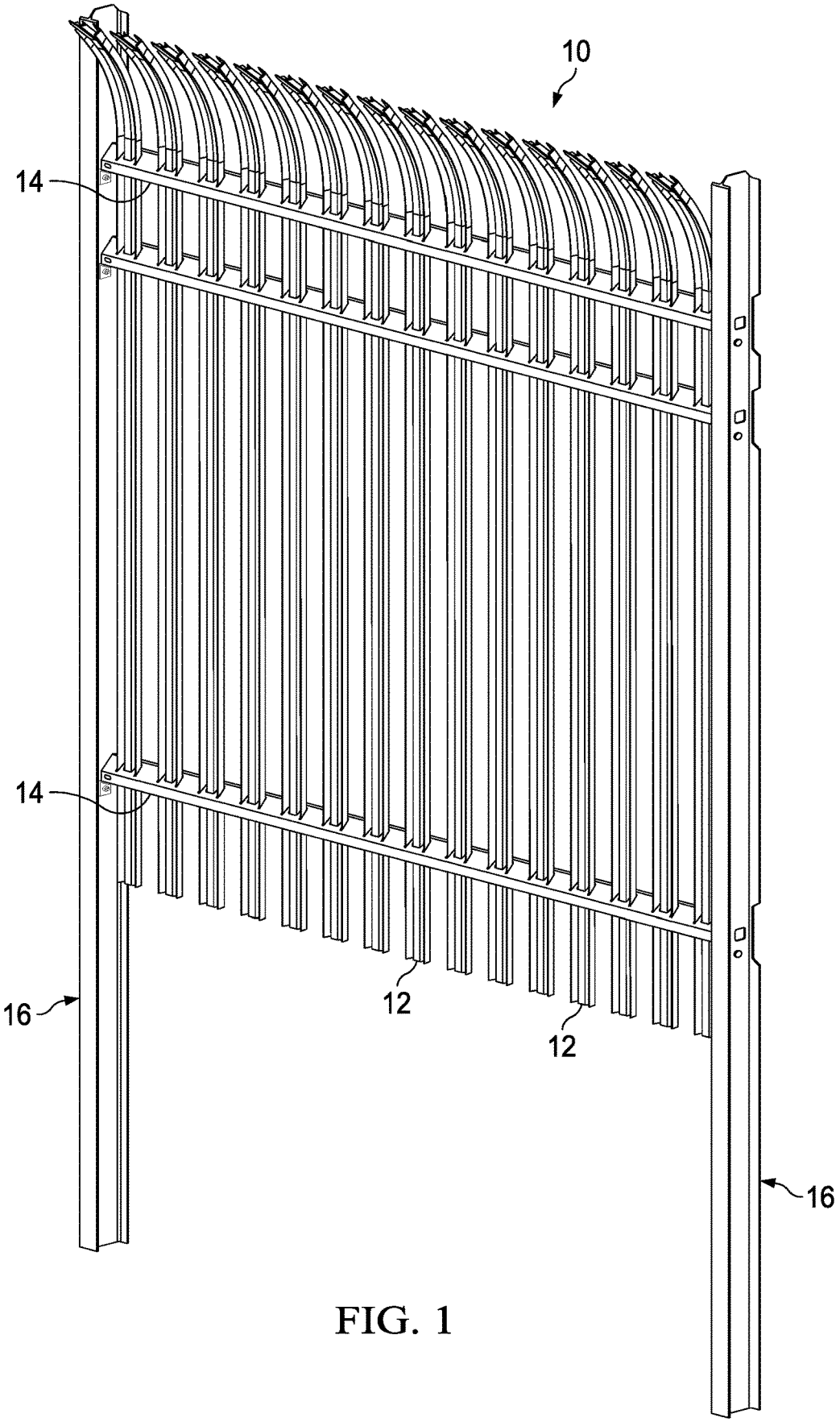
FIG. 1 is a perspective view of an embodiment of a security fence panel according to the teachings of the present disclosure.

Reference is made to FIG. 1A which shows a perspective view of a security fence 10, which may also be referred to as a palisade. A perimeter can be secured by joining the security fence 10 with additional security fences 10 to enclose a perimeter. Embodiments of the security fence 10 incorporate a slide lock bar, which secures the pickets 12 (also referred to as pales) to at least one of the rails 14 and allow the rails 14 to be disposed at a rake angle with respect to the pickets 12 and fence posts, such that the pickets 12 and posts are vertical and the rails 14 are angled to follow changes in elevation of the terrain. Certain embodiments of the security fence 10 incorporate a reinforcing cable (see FIG. 10) that is supported by at least one rail 14. The reinforcing cable adds strength to the security fence 10 to allow it to withstand a vehicle impact that would otherwise breach the security fence 10 and expose the protected area.

Each rail 14 is attached at one end to a first post 16 and at an opposite end to a second post 16. One or more of the posts 16 may extend into the ground. According to some embodiments, a hole may be dug into the ground at a depth of 4-6 feet. The bottom portion of the post 16 may be received in the hole, and then the hole may be filled with concrete to secure the post 16 into the ground. An end of the reinforcing cable may also be embedded in concrete or other ballast substrate, such as gravel and the like. The substrate acts as a deadman for the reinforcing cable. Each post 16 extends into the ground. Any suitable number of posts 16 may be set in a concrete substrate. This disclosure contemplates any suitable spacing of posts 16 that are secured in a concrete substrate depending on the desired strength of the fence 10 and the vehicle impact desired to be guarded against. Other posts 16 that support the rails 14 may be received in the ground without being secured in a concrete substrate.

According to one embodiment, the security fence 10 includes three rails 14 that are vertically spaced apart. A bottom rail 14 is disposed proximate the ground to maintain the horizontal spacing of the lower ends of the pickets 12. An upper pair of rails 14 is disposed at an upper end of the pickets 12 opposite the lower end. The rails 14 hold a plurality of pickets 12, also referred to as pales. The rails 14 may be configured to hold any suitable number of pickets 12, for example fifteen pickets 12. All of the rails 14 of the security fence 10 may be identical to each other.

Figure 2A:
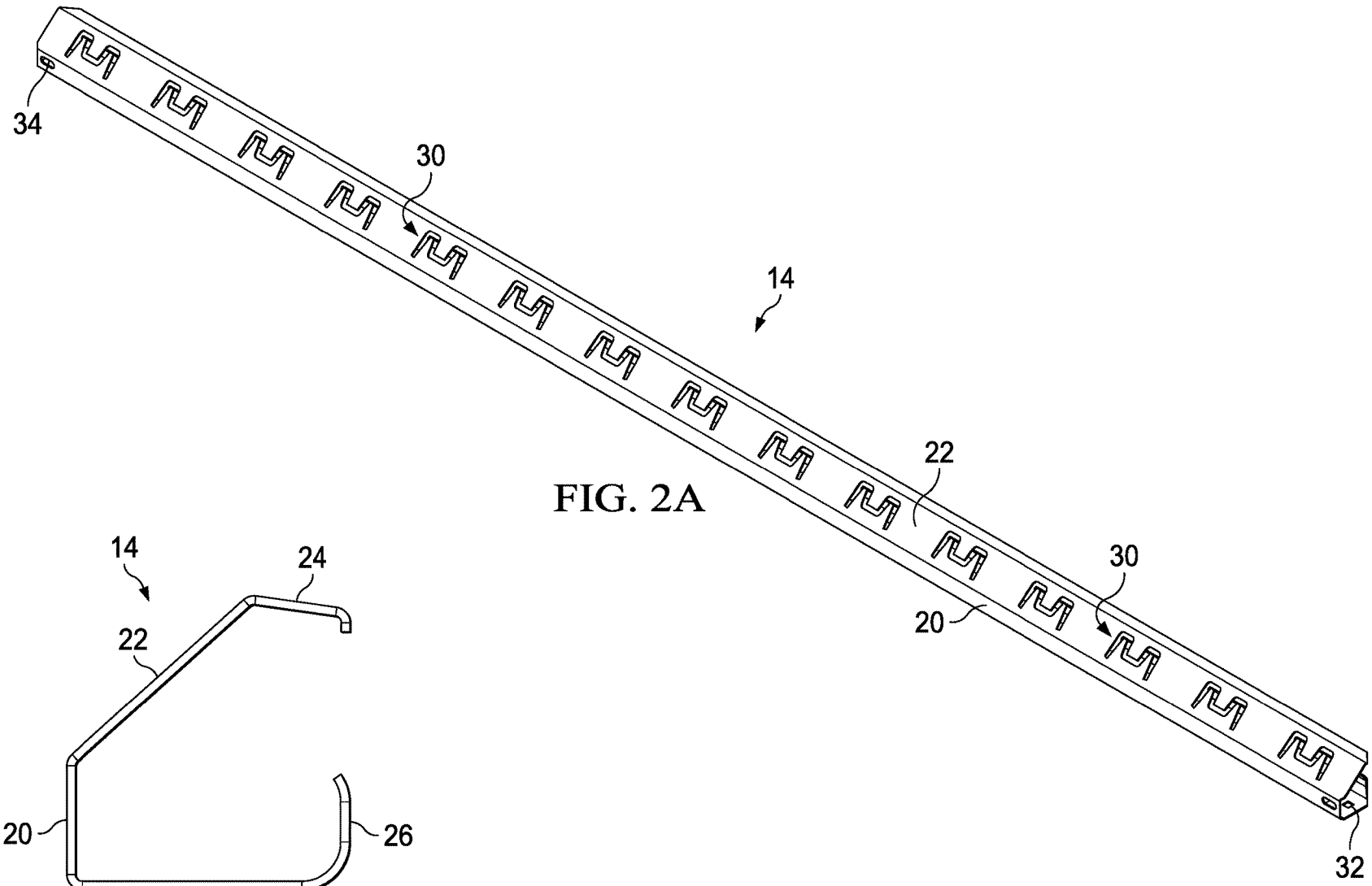
FIGS. 2A and 2B are perspective and an end view respectively of a rail of the security fence panel of FIG. 1.
Figure 2B:
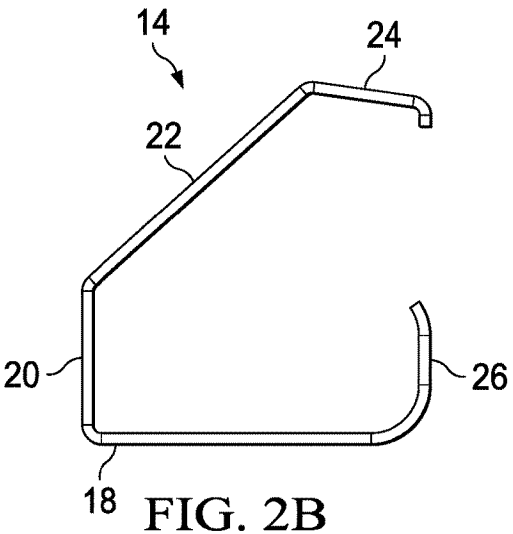
Figure 2C:
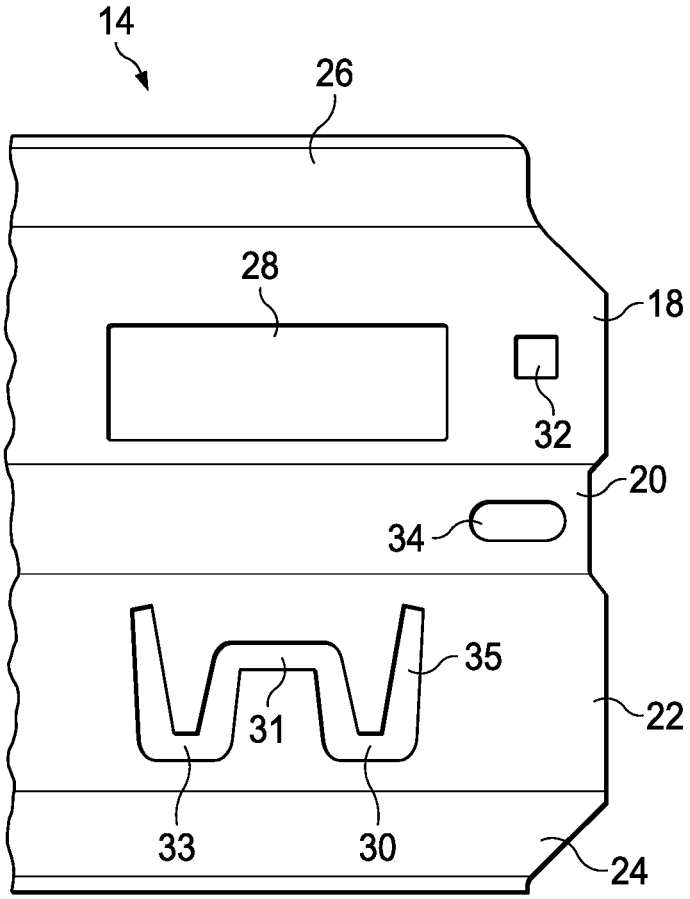
FIG. 2C is an overhead, plan view of the rail of FIGS. 2A and 2B prior to forming into the shape shown in FIG. 2B.

FIGS. 2A, 2B, and 2C are various views of one of the rails 14. The rail 14 may be roll formed from steel, for example 11-14 gauge steel, or other suitable metal depending on the desired strength of the security fence 10. According to one embodiment, the rails may be formed from 11 gauge steel. Each rail 14 includes, as integral portions of a single unitary body, a bottom wall 18, a front wall 20, an upper wall 22, an overhang wall 24, and a rear wall 26. The upper wall 22 extends at a non-perpendicular angle from the front wall 20. The overhang wall 24 extends from the upper wall 22. The geometry of the rail 14 functions to increase the strength of the rail 14. The rail geometry also functions to increase the difficulty one would encounter in attempting to climb over the security fence 10. The slope of the upper wall 22 functions to better prevent a climber from having a secure step on the rails 14, while still allowing space within the rail 14 for the slide lock bar.

A plurality of bottom openings 28 are disposed spaced apart along the length of the bottom wall 18. Each of the bottom openings 28 may be generally rectangular and provides clearance for the pickets 12 to be disposed at an angle with respect to the rails 14. According to an alternate embodiment, the bottom openings 28 may be trapezoidal and taper to correspond to the cross section/profile of the pickets 12. A plurality of upper openings 30 are disposed spaced apart along the length of the upper wall 22 and aligned with the bottom openings 28. Any suitable number of bottom openings 28 and upper openings 30 are contemplated by the present disclosure, for example fifteen.

A picket 12 is received through a respective bottom opening 28 and upper opening 30 of each of the plurality of vertically spaced apart rails 14. As described in more detail below, a slide lock bar secures the plurality of pickets 12 in a respective rail 14 and allows angular displacement of the pickets 12 with respect to the rails 14. According to one embodiment, the upper openings 30 are shaped to correspond to the contours of the pickets 12. According to the illustrated embodiment, the upper openings 30 have are generally "W" shaped. However, pickets 12 with a D-shape cross section are also contemplated by the present disclosure. The contours of the pickets 12 create geometry that strengthens the pickets 12.

Fastener holes to allow the rail 14 to be secured to the posts 16 are formed at each end of the rail 14. A square bracket fastener hole 32 is formed in the bottom wall 18 proximate a lateral end of the rail 14. The square bracket fastener hole 32 may be any suitable shape, for example square or circular. An adjustable bracket slot 34 is formed in the front wall 20 proximate each lateral end of the rail 14. The adjustable bracket slot 34 receives a fastener, and the slot 34 allows the rail to be displaced with respect to the post 16, such that a non-perpendicular angle between the rail 14 and the post 16 may be adjusted. Such angular adjustment allows the rails 14 to rake to follow the slope of the terrain. According to some embodiments, the rake angle may be adjusted between +/−0 to 10 degrees. Thus, the security fence 10 may automatically rake to accommodate up to a 10 degree upward slope of the terrain or a 10 degree downward slope of the terrain.

According to one embodiment, the rail 14 may be formed from a steel blank that is punched to form the bottom openings 28, the upper openings 30, the square bracket fastener hole 32, and the adjustable bracket slot 34, and any other through hole. Once punched, the punched steel may be roll formed into the rail geometry shown in FIGS. 2A and 2B. Alternatively, the rail 14 may be brake formed using a press brake forming machine. As shown in FIG. 10, the bottom wall 18 may support a cable, for example a data cable or high and low voltage cabling. Alternatively, as described in more detail below, the one or more of the rails 14 may support a heavy duty steel braided reinforcing cable that is disposed behind the pickets 12 and in front of the rear wall 26. A slide lock bar is disposed in front of the pickets 12 and behind the front wall 20.

Figure 3B:
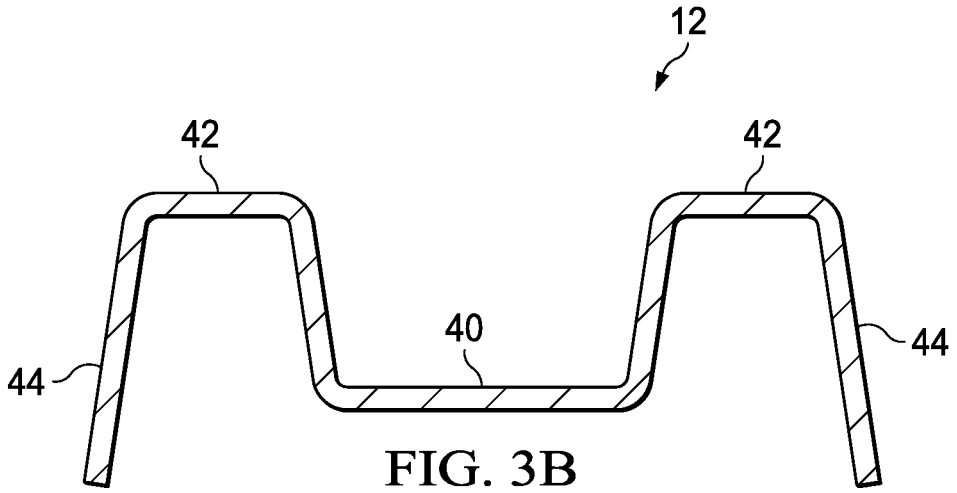
FIGS. 3A, 3B, and 3C are perspective, side, and cross section views respectively of a picket of the security fence panel of FIG. 1.
Figure 3A:
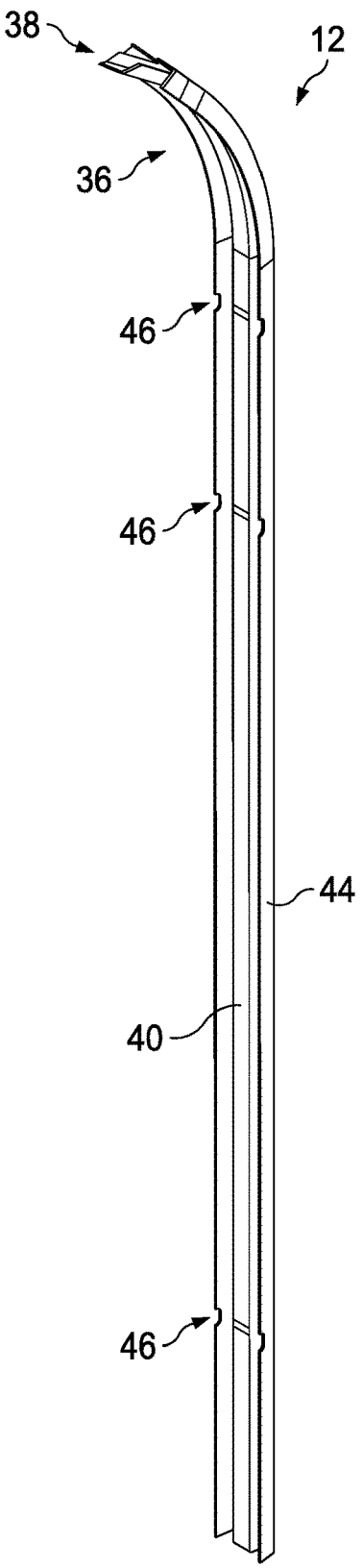
Figure 3C:
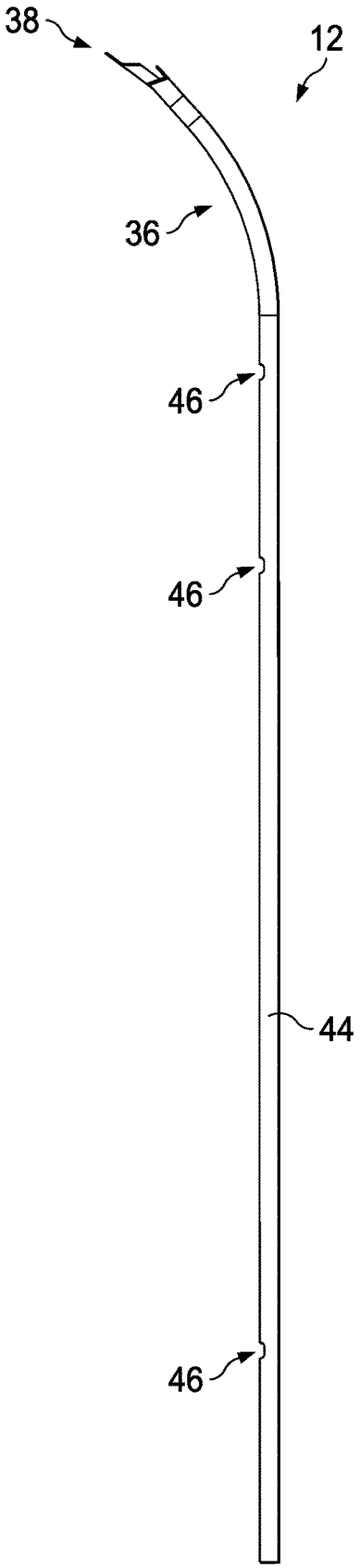

FIGS. 3A, 3B, and 3C illustrate an embodiment of the picket 12 (also referred to as a pale or a palisade). Alternate picket embodiments are shown in FIGS. 12-15. The picket 12 may be any suitable length depending on the level of security provided by the security fence 10. For example, the pickets 12 may be provided in lengths of 70 inches, 94 inches, 118 inches, or 142 inches. The pickets 12 may be formed by roll forming a blank of 14 gauge steel or other suitable metal. Roll forming the steel into the geometry shown increases the strength of the picket 12. In an embodiment, a curved end 36 is disposed at an upper portion of the picket 12. The curved end 36 is disposed to arc toward the unsecured side of the security fence to make it more difficult for the security fence 10 to be breached by climbing over it. According to one embodiment, the curved end 36 may have a radius of approximately 16 inches and may extend approximately 14 inches from a vertical portion of the picket 12 to the tip. Pointed tips 38 are also disposed at a top of the picket 12 in some embodiments to further deter breach by climbing the fence. According to some embodiments, each picket 12 may include three or more pointed tips 38. The steel of the pickets 12 may be formed such that the pointed tips 38 have an edge that may be razor sharp.

The picket 12 includes a center web 40 that transitions into a pair of lateral webs 42. A leg 44 extends from each lateral web 42. According to one embodiment, the legs 44 extend beyond the center web 40. The center web 40, the lateral webs 42, the legs 44, and the transition portions are portions of a single integral bar. The profile of the picket geometry corresponds to the geometry of the upper opening 30 in the upper wall 22 of the rail 14. For example, a center web opening 31 provides clearance for the center web 40 of the picket 12. A pair of lateral web openings 33 provide clearance for the lateral webs 42 of the picket 12, and leg openings 35 provide clearance for the legs 44 of the pickets 12. According to an alternate embodiment, the upper openings 30 may be shaped to provide clearance for a picket 12 with a D-section.

With reference to FIG. 3C, a plurality of notches 46 are formed spaced apart vertically along the length of the picket 12. The notches 46 are disposed to correspond to locations where the picket 12 is disposed within the rail 14. According to an embodiment, a lower notch 46 is disposed at a lower end of the picket to correspond to the lower rail 14. A pair of upper notches 46 are disposed proximate an upper end of the picket 12 to correspond to the two upper rails 14. The notches 46 may have a vertical length of approximately one inch, for example ⅞ of an inch. The vertical length allows engagement of the slide lock bar 48 and adjustment of a rake angle between the rail 14 and the picket 12 in a range of +/−0-10 degrees.

According to one embodiment, the notches 46 are formed in the legs 44 of the pickets 12. Forming the notches 46 in the legs may maintain the strength of the picket 12 because the notch 46 is not formed to remove material from the center web 40. According to an alternate embodiment, the notch 46 may be formed in the center web 40 (see FIG. 12B) or the picket 12 may be rotated 180 degrees in the rail 14 and the notch 46 may be formed in the lateral webs 42 (see FIG. 13C). Additional notches 46 may be formed if the security fence 10 includes more than three rails 14. Two notches 46 or one notch 46 may be included in the pickets 12, if the security fence 10 is formed from one or two rails 14.

Figure 4:
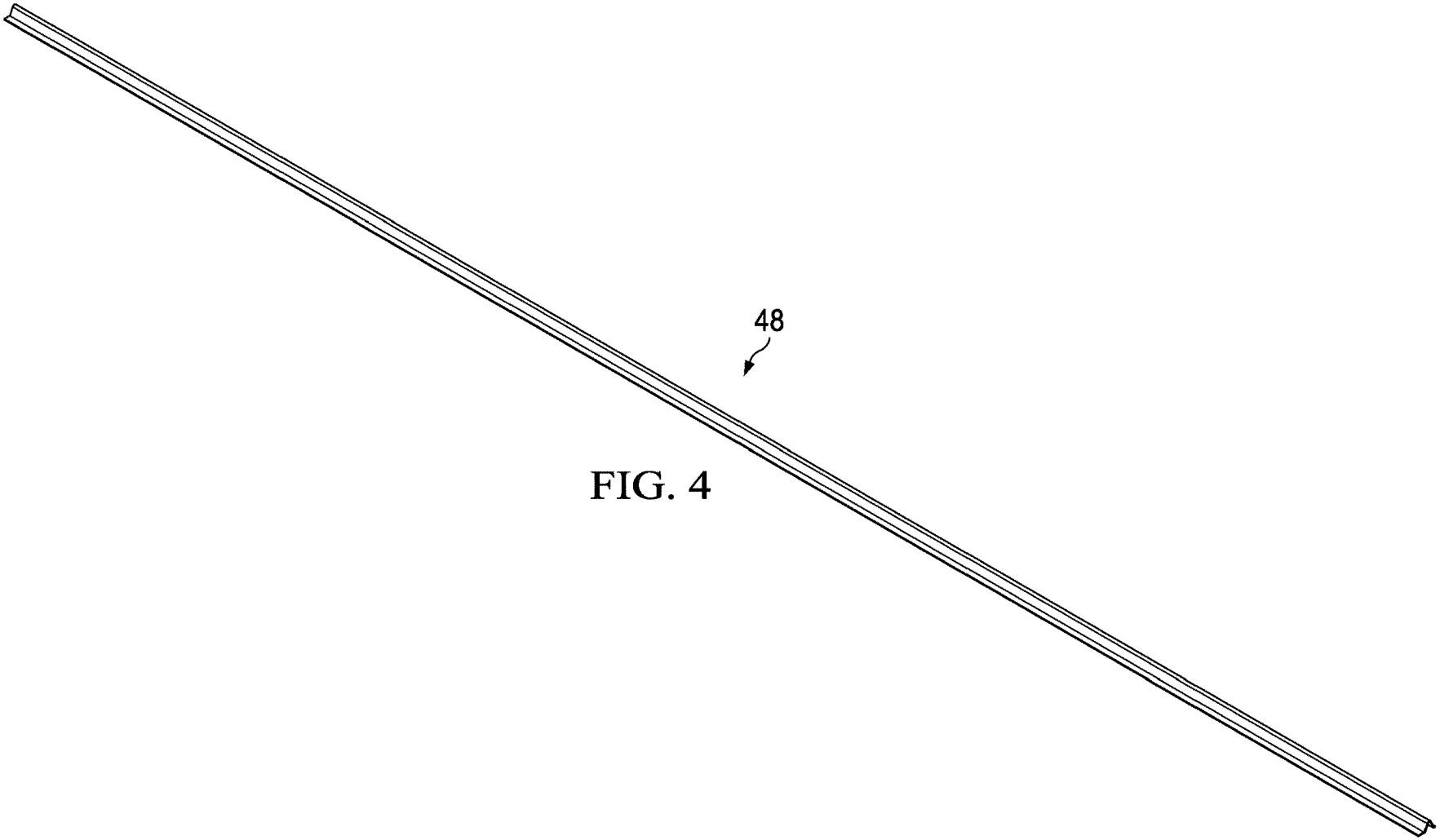
FIG. 4 is a perspective view of a slide lock bar used with a security fence panel according to the teachings of the present disclosure.

FIGS. 4A and 4B illustrate various views of a slide lock bar 48. The slide lock bar 48 may be roll formed or brake formed from a blank of 19 gauge steel, or other suitable metal with a suitable thickness depending on the desired strength of the security fence 10. The slide lock bar 48 may be generally "V" shaped and may include a ridge 50 and an extension portion 52. A single slide lock bar 48 extends through a rail 14 and is supported by a bottom wall 18 of the rail 14 and engages the notches 46 in each picket 12 supported by the rail 14. Each of the bottom rails 14 and the pair of top rails 14 may receive a slide lock bar 48. According to one embodiment, the extension portion 52 contacts the bottom wall 18 of the rail 14 and the ridge 50 is received by the notches 46. The engagement of the notches 46 with the ridge 50 allows the rail 14 to be raked at a rake angle in a range of +/−0-10 degrees with respect to the pickets 12.

Figure 5:
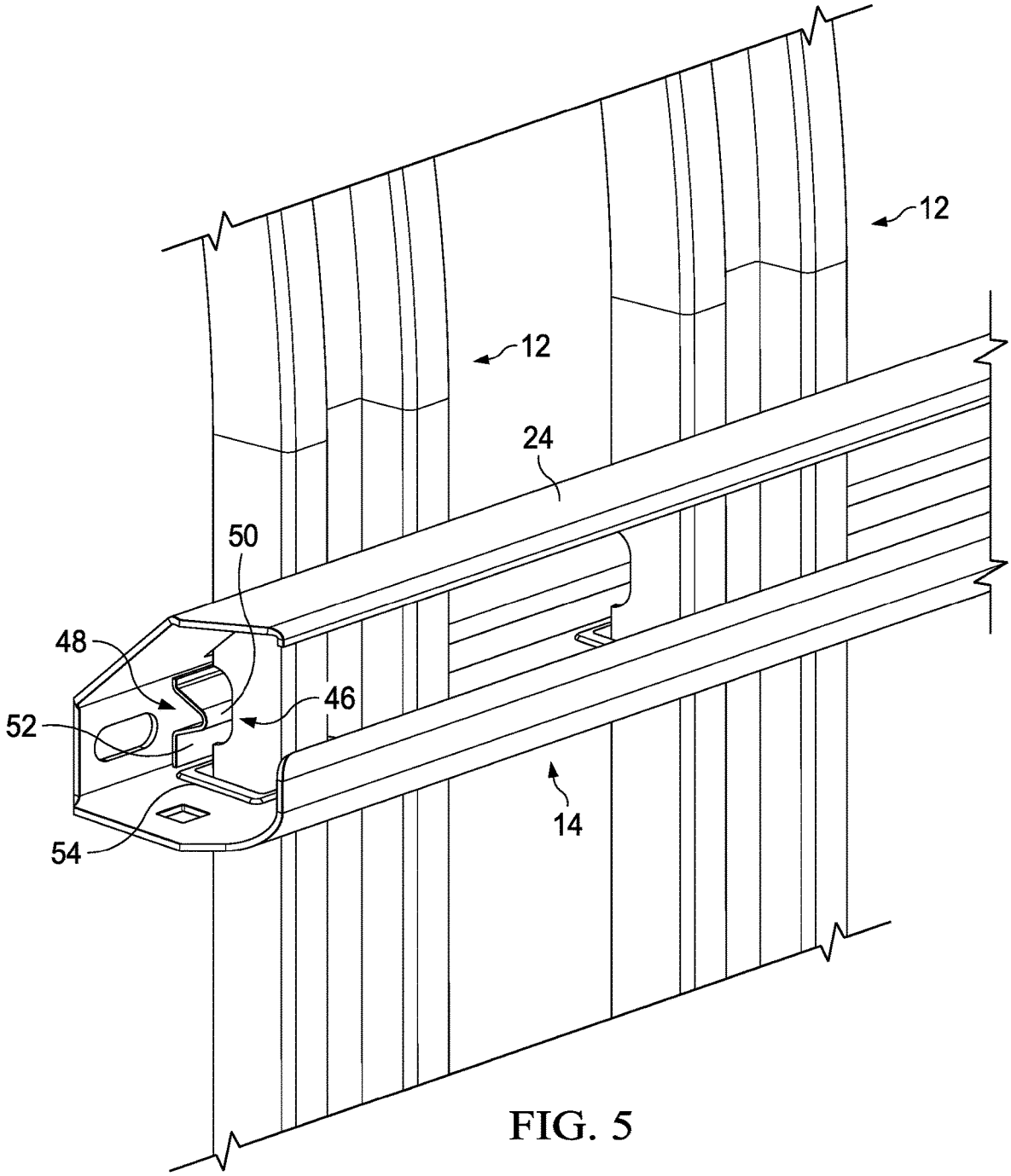
FIG. 5 is a detail view of a portion of the security fence panel of FIG. 1 showing engagement of the slide lock bar with the pickets and a rail according to the teachings of the present disclosure.

FIG. 5 illustrates the assembly of the rail 14, the picket 12, and the slide lock bar 48 in a square configuration, where the picket 12 is perpendicular to the rail 14. The ridge 50 of the slide lock bar 48 is received by the notches 46, such that the picket 12 is constrained from vertical movement with respect to the rail 14. The contact of the pickets 12 and the slide lock bar 48 may be the only contact that holds the pickets 12 in position. Thus, according to certain embodiments, the pickets float within the bottom openings 28 and the upper openings 30 in the rails 13. The w-shaped upper opening 30 and the bottom openings 28 prevent the pickets 12 from unintentional disengagement with the slide lock bar 48.

According to an alternate embodiment, the slide lock bar 48 contacts inner surfaces of the notches 46 and wedges the picket 12 between the ridge 50 and a back edge of the bottom opening 28. In this manner, the picket 12 is constrained from generally horizontal displacement in the rail 14. Alternatively or in addition to being wedged by the slide lock bar 48 and the bottom opening, the picket 12 may be wedged by the slide lock bar 48 toward rear surfaces of the upper opening 30.

Figure 6:
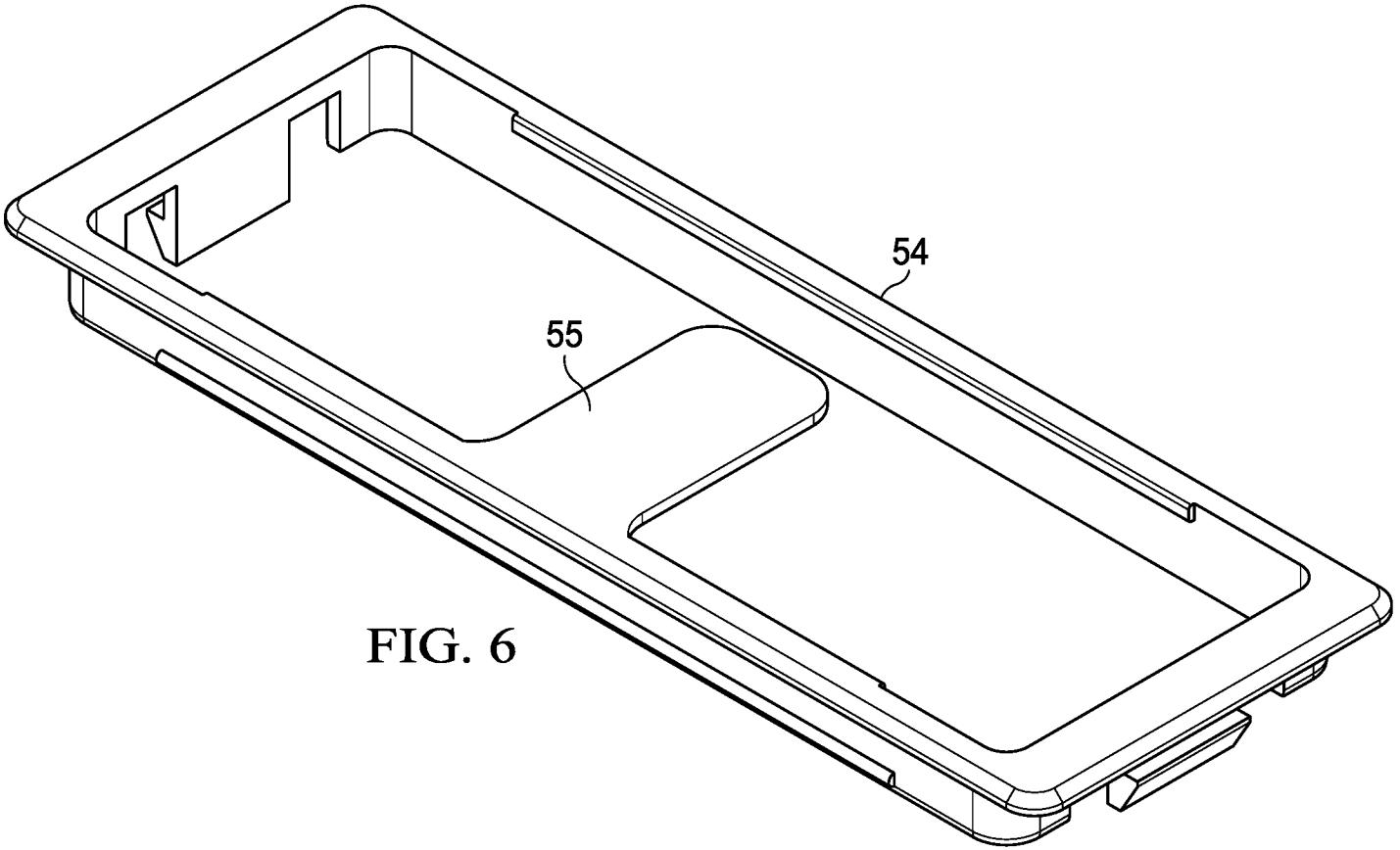
FIG. 6 is a perspective view of a grommet used with the security fence panel of FIG. 1.

According to one embodiment, a grommet 54, as shown in FIG. 6, is disposed in each of the bottom openings 18. The grommet 54 may be formed of a polymeric material, such as nylon with glass particulate. The grommet 54 may be formed using any suitable polymer forming method, such as injection molding. The grommet 54 may protect the edges of the bottom opening 28 from being damaged by the pickets 12 during installation of the pickets 12. This may maintain a powder coated finish of the pickets 12 and the rails 14, which may prevent the pickets 12 and the rails 14 from rusting or otherwise corroding. The grommet also serves to reduce friction that would otherwise exist between the metal picket 12 and the metal rail 14 during assembly. The grommet 54 also reduces a rattle noise that might otherwise be generated between the pickets 12 and the rails 14.

The grommet 54 may have a tongue portion 55 extending from a side wall centered within the grommet 54. When a picket 12 is inserted through the grommet 54 it displaces the tongue portion 55, which is resilient. The displaced tongue portion 55 applies a force to the picket 12, and more particularly, the tongue portion 55 contacts the center web 40 of the picket 12 and applies the force as the tongue portion is biased to return to its natural position. The force applied by the tongue portion 55 to the picket 12 reduces rattle that might otherwise occur between the rail 14 and the picket 12.

As illustrated in FIG. 6, constraining the pickets 12 with a slide lock bar 48 allows the rails 14 to automatically adjust to a range of rake angles with respect to the pickets 12. For example, gravity will cause the picket 12 to be disposed generally vertically, while the rail 14 is adjusted and secured to the post 16 over a range of rake angles depending on the terrain on which the security fence 10 is installed. A similar slide lock embodiment to the present disclosure is disclosed in U.S. Pat. No. 6,752,386 filed on May 13, 2003 and issued to Bundy, which is incorporated herein by reference. According to an embodiment, the rail 14 is adjustable to a non-perpendicular rake angle in a range of +/−0-10 degrees with respect to the pickets 12 and the posts 16.

Figure 7:
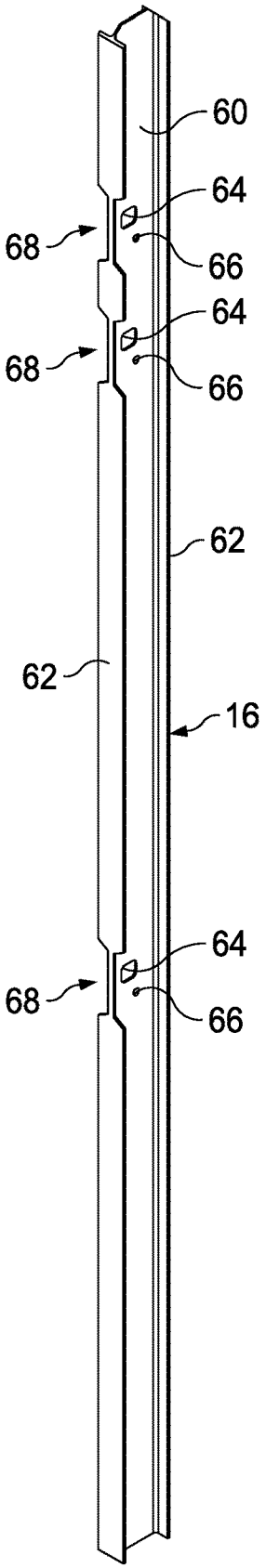
FIG. 7 is a perspective view of a post of the security fence panel shown in FIG. 1.

FIG. 7 is a perspective view of an embodiment of a post 16. A lower portion of the post 16 is embedded in the ground, for example in a concrete substrate or other suitable substrate material filled in a hole. A length of the post 16 may be in a range of 108 to 192 inches, for example 132 inches. The post 16 is generally a steel I-beam that includes a web 60 that separates a pair of flanges 62 that extend perpendicularly from the web 60. The I-beam may have a steel thickness of 0.15 inches, or any other suitable thickness depending on the desired strength of the security fence 10.

A plurality of cable holes 64 are spaced apart vertically along the length of the post 16. The cable holes 64 facilitate a cable, such as a data cable, a high or low voltage cable, or a reinforcing cable, traversing the posts 16. According to one embodiment, the cable holes 64 are generally square with rounded internal corners. The cable holes 64 may be any suitable size, for example in a range of 1-2 inches square. The cable holes 64 are disposed to correspond to locations of the attachment of the rails 14 to the posts 16 using the square and adjustable brackets shown in FIGS. 8 and 9. A plurality of rail support bracket fastener holes 66 are disposed spaced apart along the length of the post 16 and proximate the cable holes 64. The fastener holes 66 receive a fastener to attach a bracket to the web 60 of the post 16. According to an embodiment, the fastener holes 66 may be tapered to allow the fastener to settle in the taper and be self-centered in the fastener hole 66. The fastener holes are disposed to allow the rail 14 to be attached to the post 16 at a location where the cable can extend through the cable holes 64 and be supported by the bottom wall 18 of the rail 14.

According to an embodiment, cutouts 68 may be made in the flange 62 at locations spaced apart along the length of the post 16. The cutouts 68 correspond to the cable holes 64 and the rail support bracket fastener holes 66. The cutouts 68 facilitate assembly of the rails 14 to the posts 16. For example, the pickets 12 may be assembled in each of the three rails 14 with three slide lock bars 48. Brackets may be secured to the web 60 of the post. This rail 14 and picket 12 assembly may be hoisted by crane or other lifting mechanism such that the ends of the rails 14 are received through respective cutouts 68 and the fastener holes 32 in the rails 14 can be aligned with corresponding holes on the brackets. In this manner, a preassembled picket and rail assembly can be more easily positioned to be secured to a pair of properly spaced apart posts 16.

Figure 8:
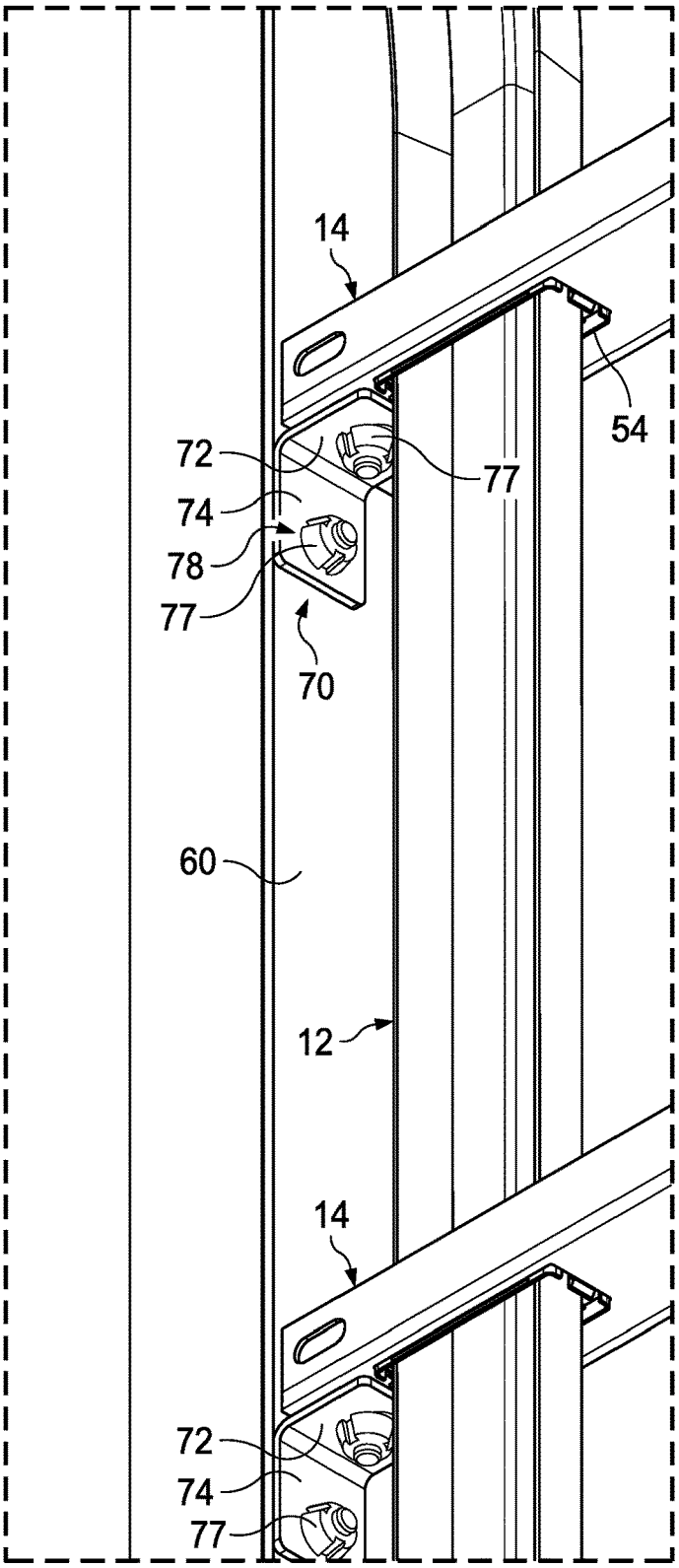
FIG. 8 is a perspective view of a portion of the security fence panel of FIG. 1 showing the connection of a post and a plurality of rails according to the teachings of the present disclosure.

FIG. 8 illustrates an assembly of the rail 14 to the post 16 using a square bracket 70. The square bracket 70 may be stamped and formed from 10 gauge steel. The square bracket 70 includes a rail support portion 72 extending perpendicularly and integral with a post coupling portion 74. A fastener hole 76 is formed in the post coupling portion 74. The fastener hole 76 receives a fastener, which is also received through the fastener hole 66 in the web 60 of the post 16. According to one embodiment, the fastener may be a bolt secured with a tri-groove nut 77. The tri-groove nut 77 may provide additional security because it is not easily removed with a standard wrench and requires a particular tool to engage and loosen or tighten the tri-groove nut. The rail support portion 72 includes a slot-shaped through hole 78 which receives a fastener that is also received through the fastener hole 32 in the bottom wall 18 of the rail 14. Once the square bracket 70 is secured to the post 16, the bottom wall 18 of the rail 14 is supported by the rail support portion 72 at a position that aligns the bottom wall 18 with a bottom edge of the cable hole 64 in the web 60 of the post 16. The slot-shaped hole 78 allows adjustability of spacing between an end of the rail 14 and the web 60 of the post 16.

Figure 9A:
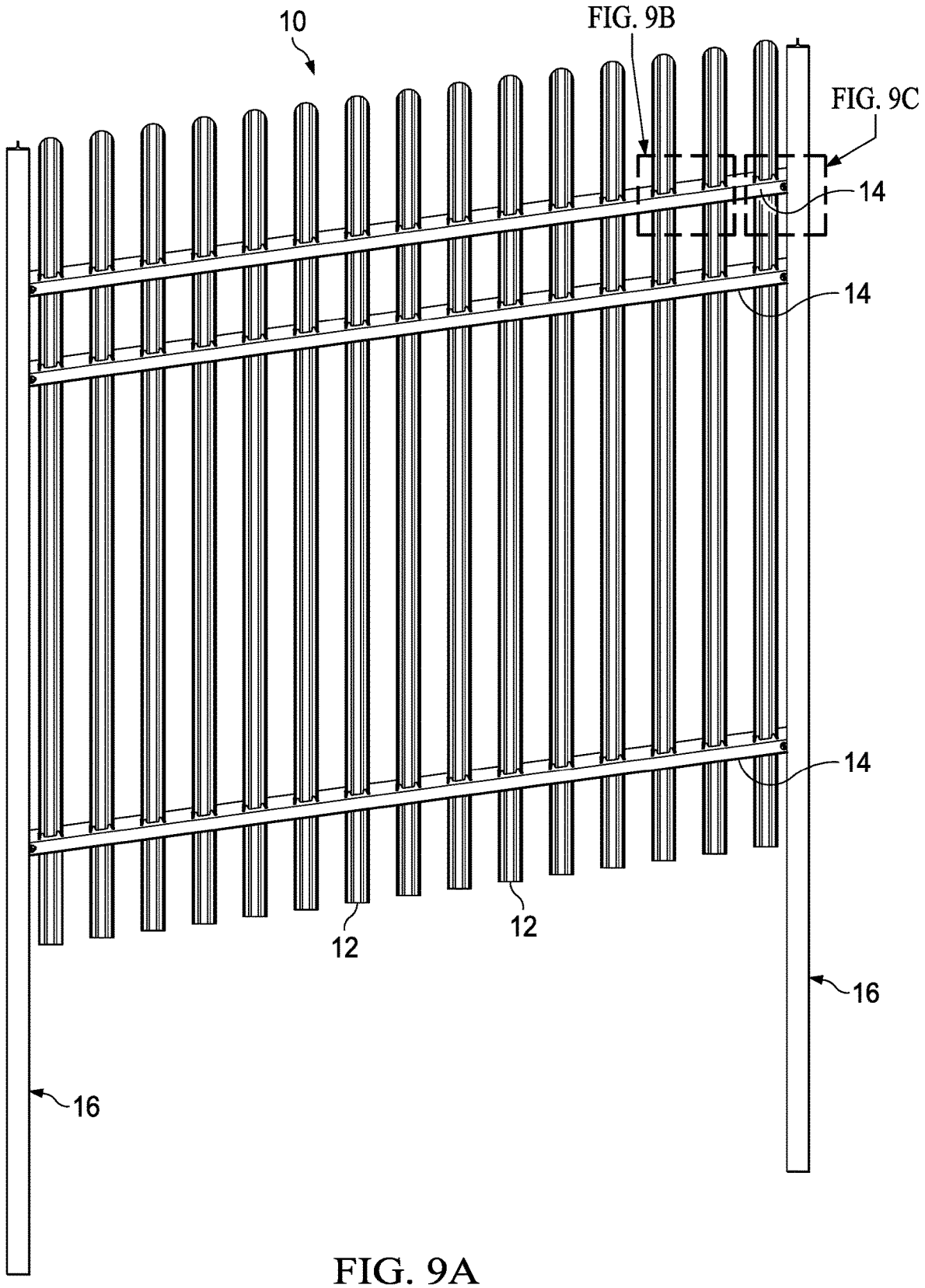
FIGS. 9A, 9B, and 9C are perspective and detail view respectively of an embodiment of a security fence panel according to the teachings of the present disclosure shown at a rake angle.
Figure 9B:
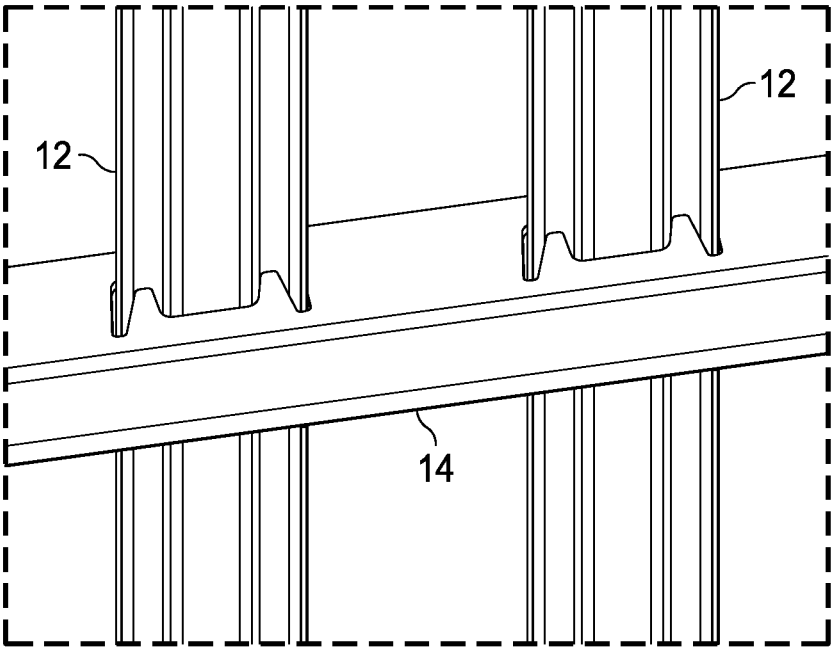

FIG. 9A is a perspective view of an embodiment of the security fence 10 shown at a rake angle to follow sloping terrain. The rails 14 are disposed at a non-perpendicular angle with respect to the posts 16 and the pickets 12. The pickets 12 include a rounded tip, as discussed in more detail with respect to FIG. 14. FIG. 9B illustrates a detail view of the junction of two pickets 12 with the upper rail 14 at a rake angle.

Figure 9C:
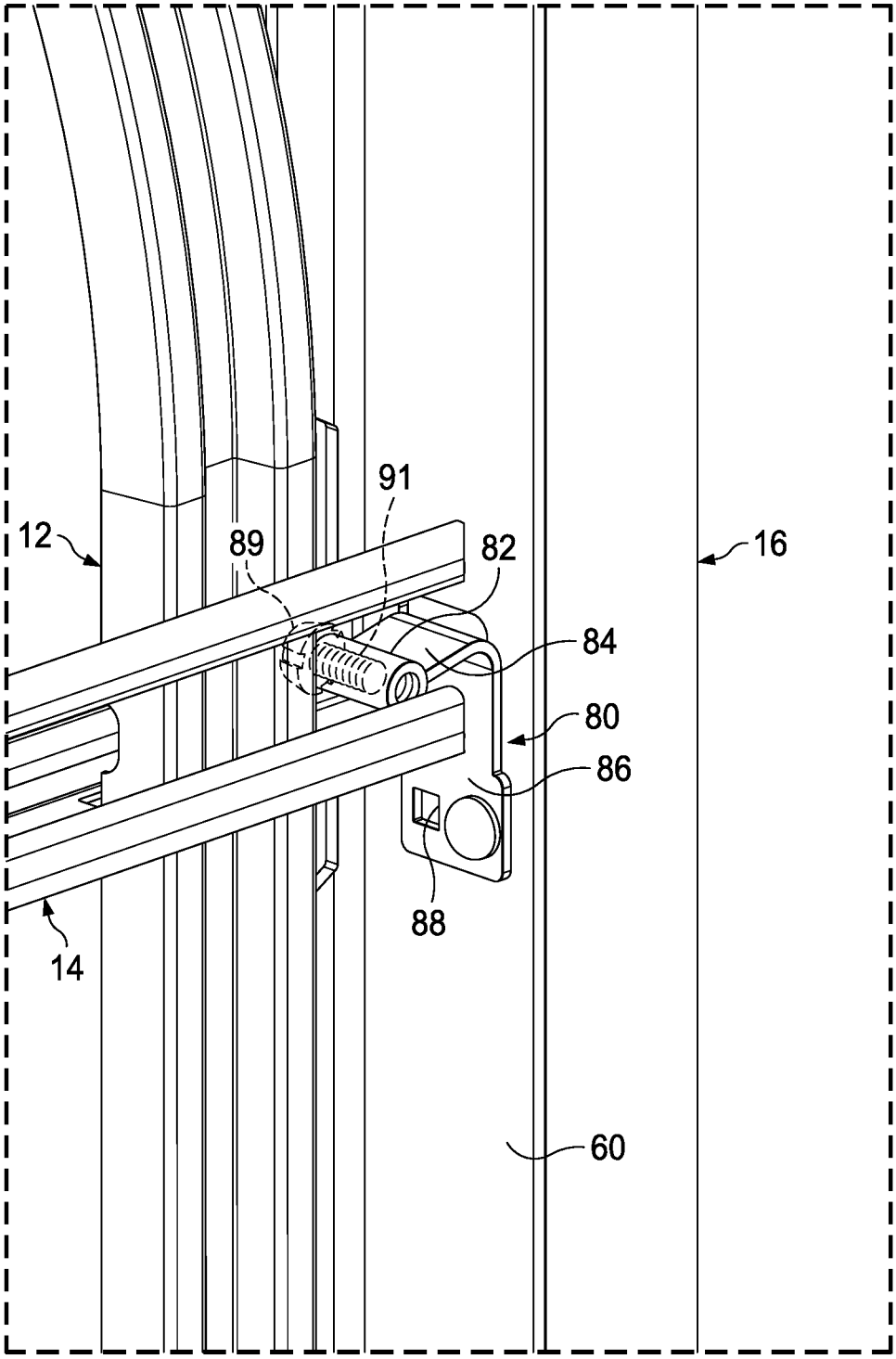

FIG. 9C is a perspective view showing the joining of a rail 14 with a post 16 according to an embodiment of the present disclosure. The assembly of the rail 14 to the post 16 employs an angle-adjustable bracket 80. The angle adjustable bracket 80 includes a barrel 82 that is welded or otherwise secured to an extension portion 84. The extension portion 84 extends from and is integral with a post coupling portion 86. The extension portion 84 forms a non-perpendicular angle with respect to the post coupling portion 86. The non-perpendicular angle provides clearance for the rail 14 to rake with respect to the post 16. The extension portion 84 and the post coupling portion 86 may be stamped and formed from a blank of 10 gauge steel.

The post coupling portion 86 includes a pair of fastener holes 88. The fastener holes 88 allow the adjustable bracket 80 to be positioned on either side of the web 60 and the barrel 82 will be positioned to allow a fastener 89 to be received through the slot 34 in the front wall 20 of the rail 14 and into a threaded bore 91 in the barrel 82. The rail 14 may rotate or pivot on the fastener 89 to adjust the rail 14 to a non-perpendicular rake angle. The fastener 89 is received through one or the other fastener holes 88 depending on which side of the web 60 of the post 16 to which the angle-adjustable bracket 80 is attached. According to one embodiment, the fastener 89 may be a tri-groove bolt. The tri-groove bolt 89 includes a bolt head with grooves formed about the periphery of the bolt head. Similar to the tri-groove nut 77, the tri-groove bolt 89 provides additional security because the bolt 89 is not easily removed with a standard wrench.

Figure 10A:
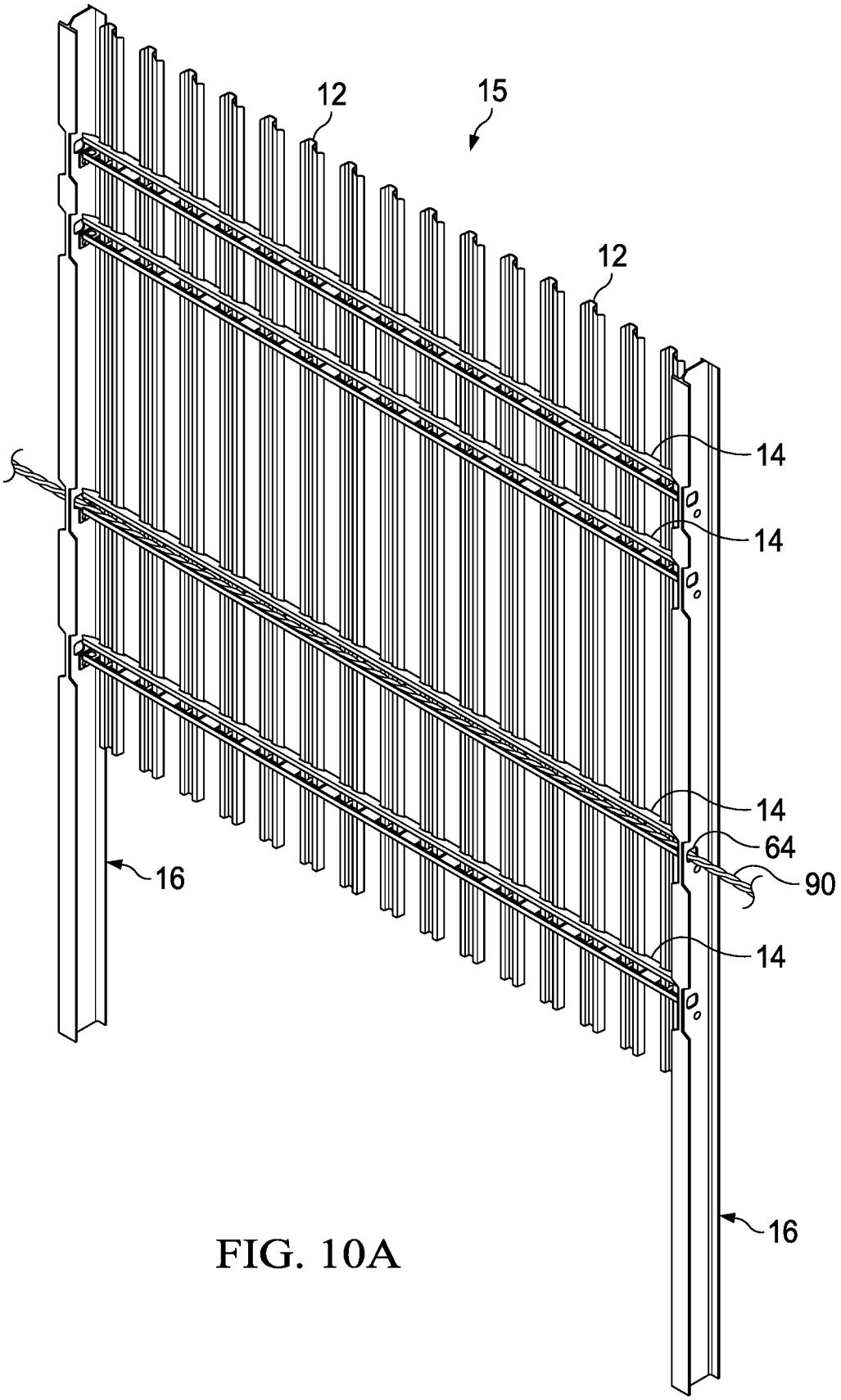
FIGS. 10A and 10B are perspective and a detail view respectively of an embodiment of a security fence panel with a reinforcing cable according to the teachings of the present disclosure.

FIG. 10A is a rear perspective view of an embodiment of the security fence 15 showing rails 14 attached to each side of a post 16. The security fence 15 includes a fourth rail 14. The present disclosure contemplates two to six rails 14 dependent on the desired strength of the security fence 15. One of the rails 14 is positioned at a height selected to withstand an impact with a moving vehicle. One or more of the rails 14 supports a reinforcing cable 90 extending through the cable hole 64 a hole in the web 60 of the post 16 and supported by the bottom wall 18 of the rail 14 disposed on each side of the post 16.

Figure 10B:
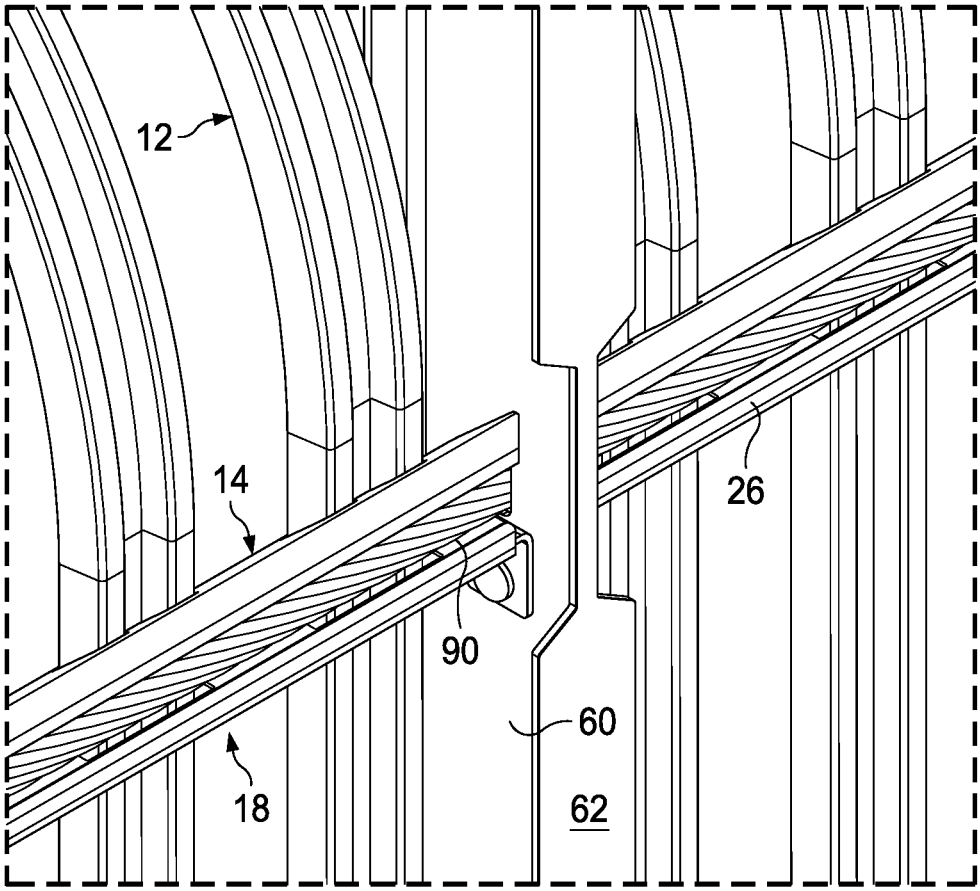

FIG. 10B is a perspective view of the junction of one rail 14 disposed on one side of the post 16 and a second rail 14 disposed on the opposite side of the post 16. The reinforcing cable 90 extends through the cable hole 64 and is supported by both rails 14 disposed on each side of the post 16. According to an alternate embodiment, the cable 90 may be a data cable and it may run through any one or more of the vertically spaced apart rails 14 of the security fence 10. Alternatively or additionally, the reinforcing cable 90 may be run through any one or more of the vertically spaced apart rails 14 disposed along the length of the post 16.

According to one embodiment, ends of the reinforcing cable may be anchored in a deadman. The deadman may be a conventional bollard post which may be a concrete post or other structure disposed behind one of the panels of the security fence 15. The reinforcing cable 90 may increase the strength of the security fence 10. In particular, one or more reinforcing cables 90 may allow the security fence 10 to maintain a secure perimeter and prevent a breach by a moving vehicle, such as a large truck that might be packed with explosives in a suicide terrorist attack on a location secured by the security fence 10.

Figure 11B:
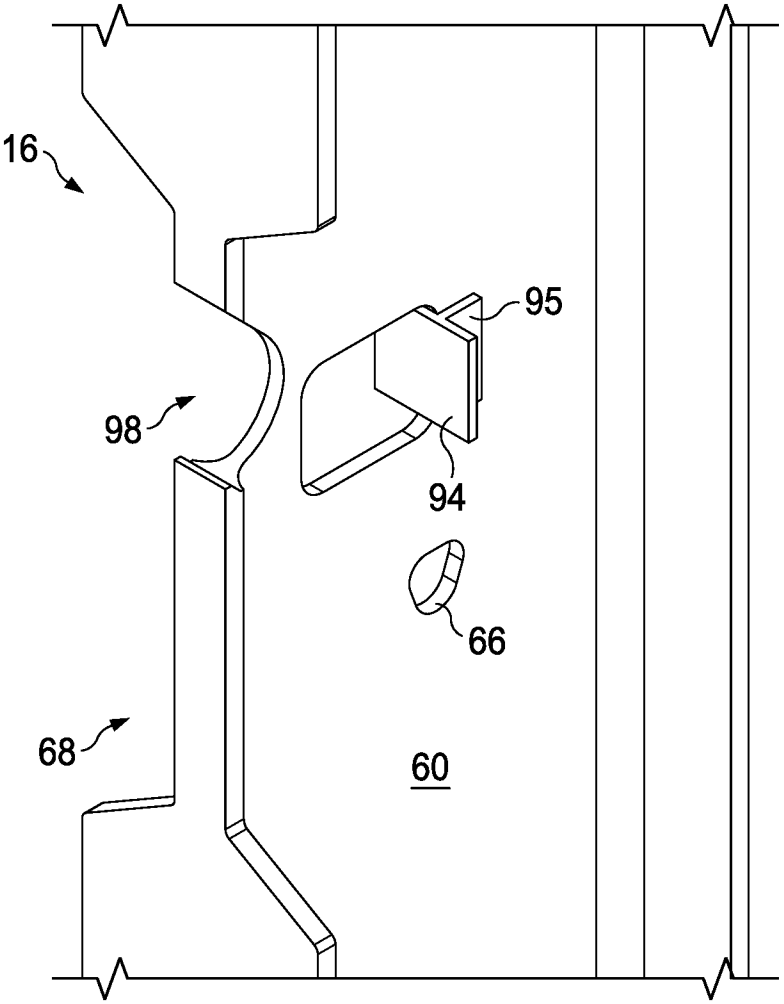
FIGS. 11A, 11B, and 11C are detail views of embodiments of shear guards used with posts of a security fence panel according to the teachings of the present disclosure.
Figure 11A:
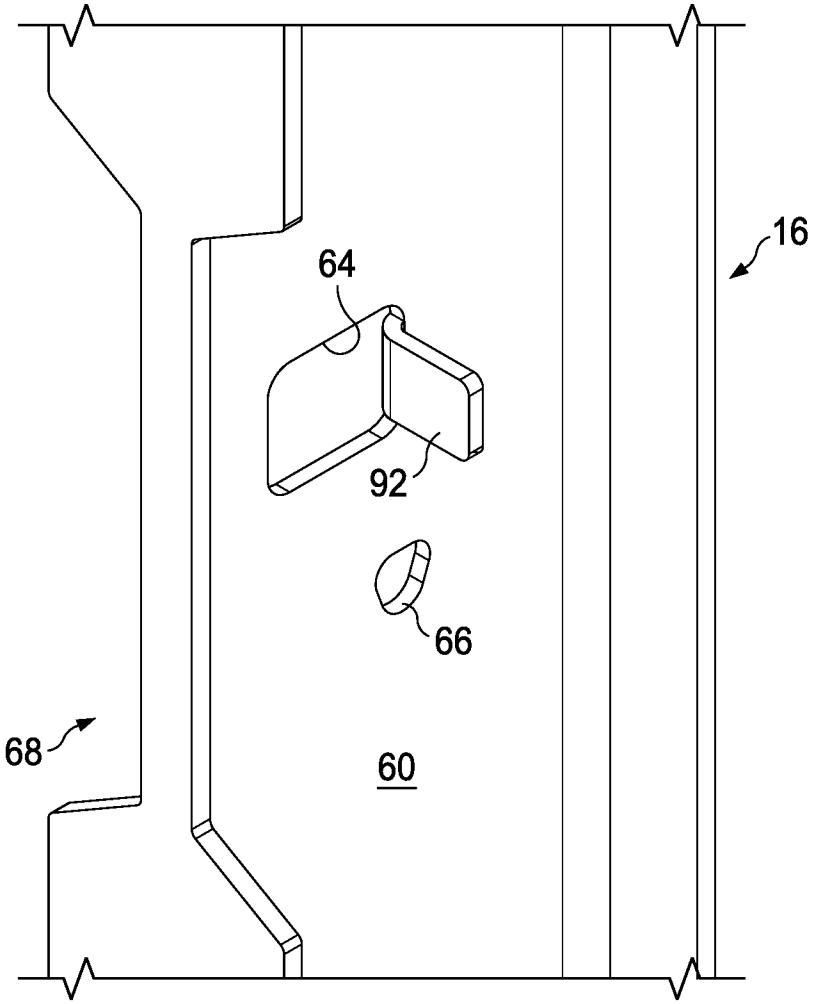
Figure 11C:
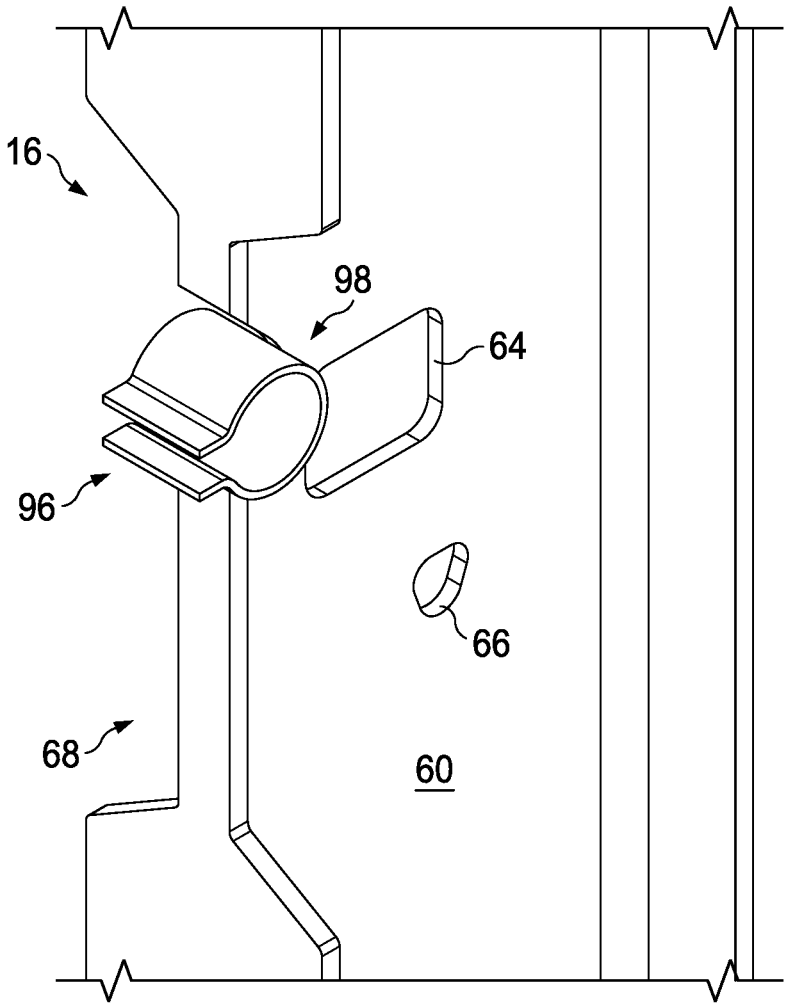

FIGS. 11A, 11B, and 11C show embodiments of cable shear guards to reduce the possibility of the web portion 60 of the post 16 shearing and possibly severing the reinforcing cable 90 in the event of an impact, such as an impact with a fast moving vehicle that is caught by the reinforcing cable 90. Shearing and severing of the cable 90 may be reduced and possibly eliminated by increasing the surface area that contacts the cable 90 in the event of an impact of a vehicle with the security fence 10. In the example shown in FIG. 11A, a tab 92 is folded to extend perpendicularly from the web 60. The tab 92 may be formed in connection with the punch or other material removal operation that forms the cable holes 64. The tab 92 is disposed at a rear edge of the cable hole 64 to increase the surface area impacting the reinforcing cable 90. According to an alternate embodiment shown in FIG. 11B, a separate plate member 94 is welded or otherwise secured to the rear edge of the cable hole 64. The plate member 94 includes a pair of legs 95 that are spaced apart to receive the web 60. The plate member 94 may be held in place by the cable 90 such that welding the plate member 94 to the web 60 is not required.

According to a further alternate embodiment, a collar 96, shown in FIG. 11C may be separately formed and welded or otherwise attached to the post 16. The collar 96 may be seated in a arcuate cutout 98 formed in the web 60. According to an alternate embodiment, the cable hole 64 may be omitted and instead replaced with the arcuate cutout 98. If further cable shear protection is desired, the collar 96 may be attached to the arcuate surface of the cutout 98. If the cutout 98 is employed, a backstop member may be secured to the flange 62 of the post 16 to better contain the reinforcing cable 90 in the arcuate cutout 98.

Figure 12A:
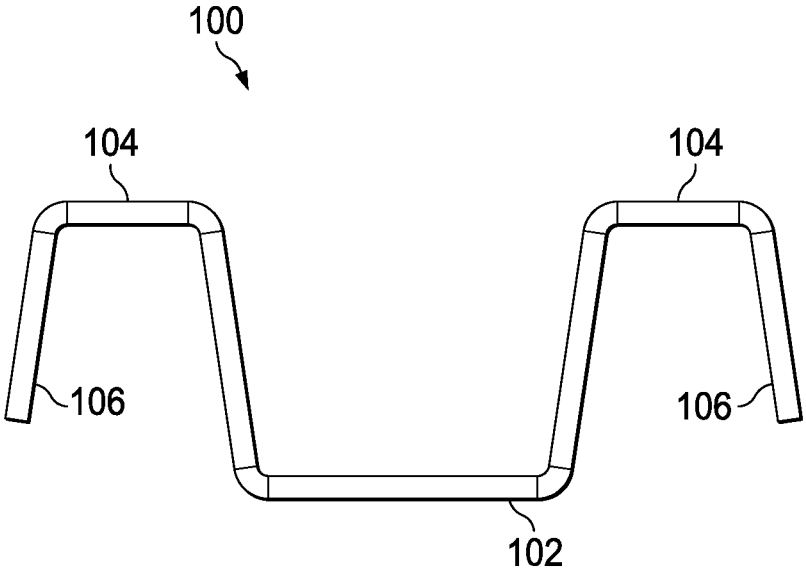
FIGS. 12A and 12B are an end view and a perspective view of an alternate embodiment of a picket used with a security fence panel according to the teachings of the present disclosure.
Figure 12B:
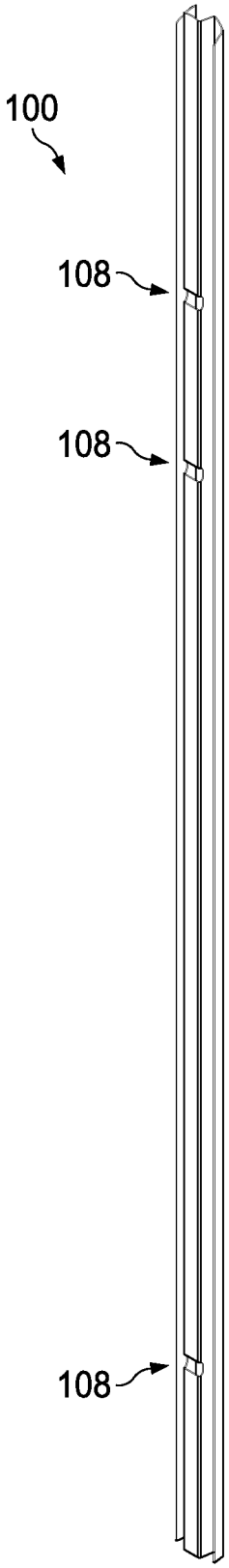

FIGS. 12A and 12B show an alternate embodiment of a profile of pickets 100. The pickets 100 include similar features to the pickets 12 previously shown and described, but the pickets 100 have a slightly different geometric profile. The pickets 100 include a center web 102, a pair of lateral webs 104 disposed on each side of the center web 102 and a pair of legs 106 extending from each lateral web 104. The center web 102 extends further than the legs 106. In this embodiment, the notches 108 may be formed in the center web 102, as opposed to the legs 106. The notches 108 are disposed along the length of the picket 100 to correspond to the position of the rails 14 and slide lock bars 48 of the assembled security fence 10. The upper openings 30 in the upper wall 22 of the rail 14 are shaped to correspond to the profile of the pickets 100.

Figure 13A:
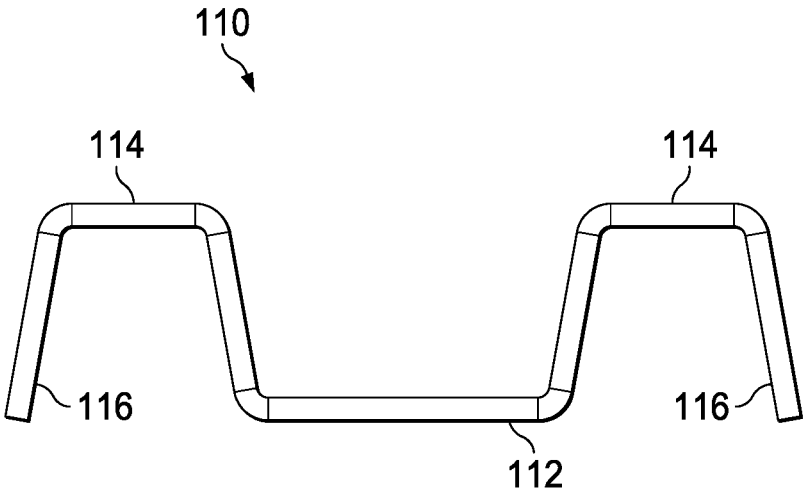
FIGS. 13A, 13B, and 13C are an end view and perspective views of an alternate embodiment of a picket used with a security fence panel according to the teachings of the present disclosure.
Figure 13B:
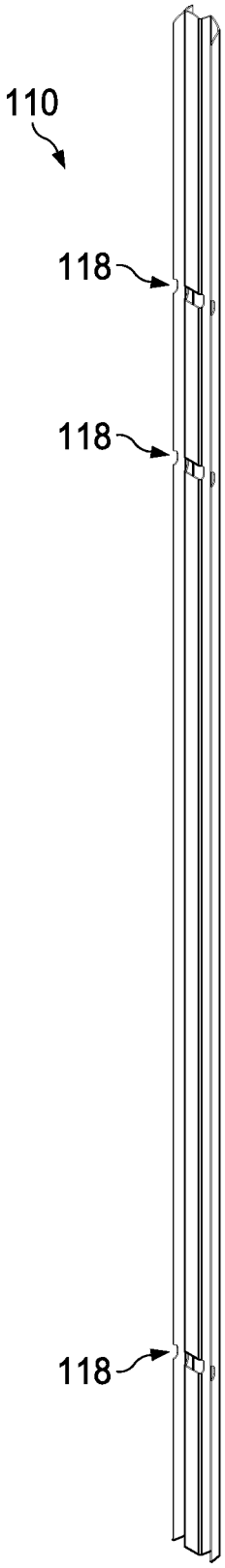
Figure 13C:
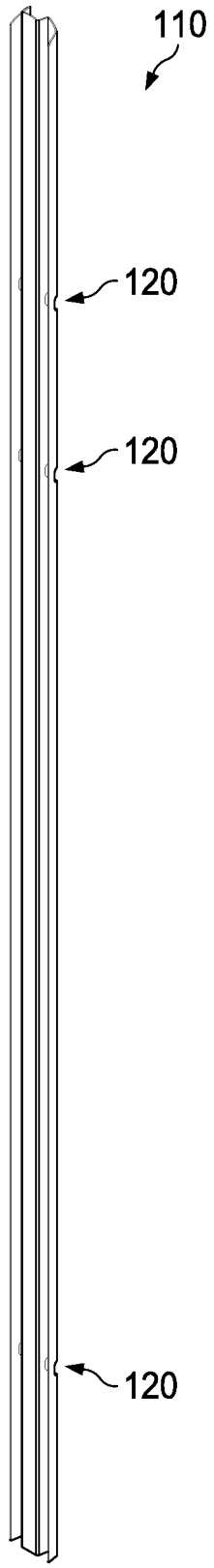

FIGS. 13A and 13B illustrate an additional alternate embodiment of a picket 110. The picket 110 includes a center web 112, a lateral web 114 disposed on each side of the center web 112, and a leg 116 extending from each of the lateral webs 114. The legs 116 extend generally even with the center web 112. In this embodiment, the notches 118 are formed in both the center web 112 and the legs 116. Alternatively or additionally, as shown in FIG. 13C, the notches 120 may be formed in the lateral web portions 114. In this manner, the pickets 110 will be flipped or reversed such that the lateral webs 114 face the front wall 20 of the rails 14 to allow the notches 120 to receive the slide lock bar 48. The upper openings 30 in the upper wall 22 of the vertically spaced apart rails 14 will also be reversed to correspond to the flipped or reverse orientation of the picket 110.

Figure 14:
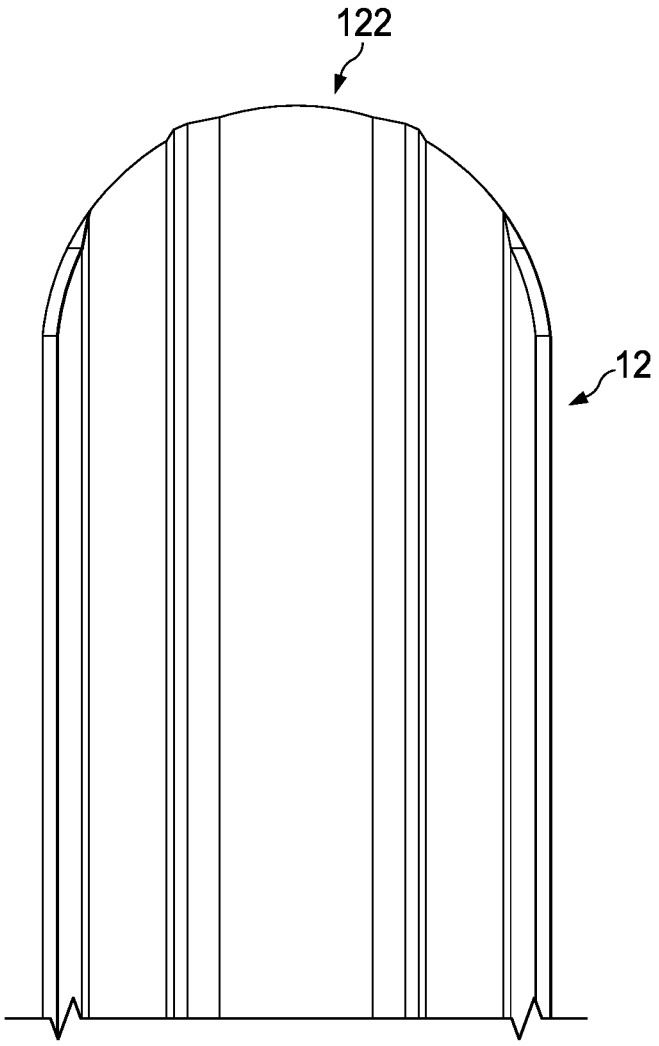
FIG. 14 is a detail view of an alternate tip of a picket according to the teachings of the present disclosure.
Figure 15:
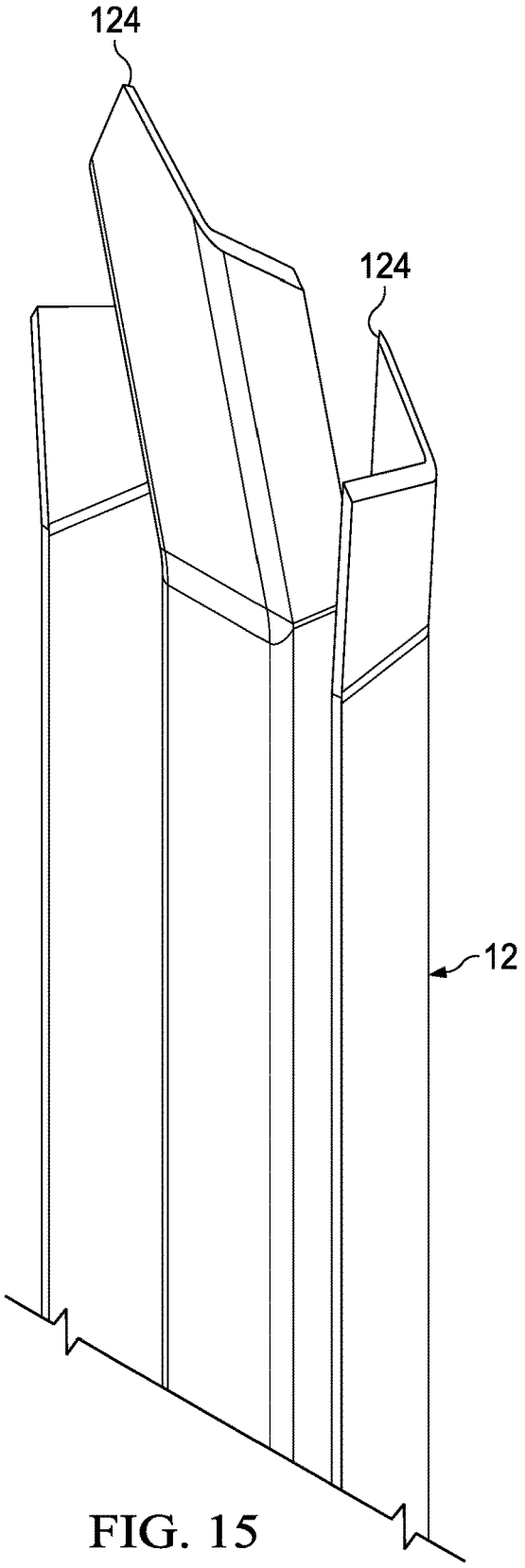
FIG. 15 is a detail view of an alternate embodiment of a picket according to the teachings of the present disclosure.

FIG. 14 shows an alternate embodiment of the tip portion of pickets 12. According to the embodiment shown in FIG. 14, a tip portion 122 of the picket 12 may be rounded. This configuration may be suitable for a perimeter where there is less risk if the security fence 10 is breached by climbing over it. The rounded tips 122 also present a less intimidating perimeter to the public. As shown in FIG. 15, the security fence 10 may include pickets 12 that include pointed tips 124 that are straight, as opposed to arced. This configuration may be appropriate for a security fence 10 where a climb over breach is associated with a risk that is less than the arced, pointed picket embodiment but greater than the risk associated with the rounded tip embodiment.

Figure 16:
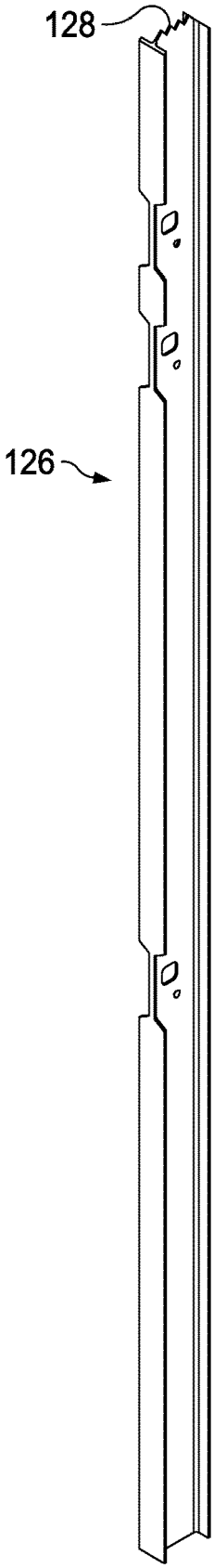
FIG. 16 is a perspective view of an alternate embodiment of a post of a security fence panel according to the teachings of the present disclosure.

FIG. 16 illustrates an alternate post 126. The post 126 may offer maximum security by including pointed tips 128 at an upper end. The pointed tips 128 deter a climb over breach at a location where there are no pointed pickets 12. The pointed tips 128 may be formed to be razor sharp.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A security fence, comprising:

a pair of posts, each post comprising a pair of flange portions separated by a web portion;

a plurality of rails supported by the pair of posts and disposed vertically spaced apart, each rail comprising a bottom wall and an upper wall, the bottom wall defining a plurality of spaced apart bottom openings, the upper wall defining a plurality of spaced apart upper openings, each of the plurality of rails secured to each web portion of each of the pair of posts by an adjustable bracket, the adjustable bracket comprising a post coupling portion secured to the web portion and an extension portion having a barrel defining a threaded bore mounted at a free end thereof to be positioned within one of the plurality of rails to allow a fastener to be received through the front wall of one of the plurality of rails and into the threaded bore in the barrel allowing a non-perpendicular rake angle between each of the plurality of rails and the pair of posts;

a plurality of pickets spaced apart along the plurality of rails, each picket extending through a respective bottom opening and a respective upper opening of each rail; and a slide lock bar disposed within one of the plurality of rails on a first side of the plurality of pickets and supported by the bottom wall of the one of the plurality of rails, the slide lock bar traversing the plurality of pickets and received by a notch in each picket, wherein engagement of the slide lock bar with the notches enables angular displacement of each picket with respect to each rail; and a cable extending through the web portion of each of the plurality of posts and disposed on the second side of the plurality of pickets.

2. The security fence of claim 1 wherein each picket forms a rake angle with each rail, the rake angle being in a range of −10 degrees to +10 degrees from perpendicular.

3. The security fence of claim 1 wherein the cable is a data cable.

4. The security fence of claim 1 wherein the cable is a reinforcing cable.

5. The security fence of claim 4 wherein a first end of the reinforcing cable is secured in a first bollard post and a second end of the reinforcing cable is secured in a second bollard post.

6. The security fence of claim 1 wherein each picket has a W-shaped profile and each of the plurality of upper openings in each rail is shaped to correspond to the W-shaped profile of each picket.

7. A security fence, comprising:

a post comprising a pair of flange portions separated by a web portion;

a first rail assembly secured to a first side of the web portion by a first adjustable bracket allowing a non-perpendicular rake angle between the first rail assembly and the post;

a second rail assembly secured to a second side of the web portion opposite the first side by a second adjustable bracket allowing a non-perpendicular rake angle between the second rail assembly and the post;

each of the first and second rail assemblies supporting a plurality of spaced apart pickets, each of the first and second rail assemblies comprising:

a rail comprising a bottom wall and an upper wall, the bottom wall defining a plurality of spaced apart bottom openings, the upper wall defining a plurality of spaced apart upper openings, the plurality of pickets extending through a respective bottom opening and a respective upper opening; and a slide lock bar supported by the bottom wall and traversing the plurality of pickets on a first side of the plurality of pickets and received by a notch in each picket, wherein engagement of the slide lock bar with the notches enables angular displacement of each picket with respect to each rail; and a cable extending through the web portion of the post and disposed on a second side of the plurality of pickets opposite the first side.

8. The security fence of claim 7 wherein the cable is selected from the group consisting of a data cable, a reinforcing cable, and a voltage cable.

9. The security fence of claim 8 wherein the cable is the reinforcing cable.

10. The security fence of claim 7 wherein the first adjustable bracket comprises a threaded bore configured to receive a bolt, wherein the first rail assembly is pivotable on the bolt.

11. The security fence of claim 7 comprising a third rail assembly disposed vertically spaced apart from the first rail assembly in a first direction and a fourth rail assembly disposed vertically spaced apart from the first rail assembly in a second direction opposite the first direction.

12. The security fence of claim 7 wherein each one of each of the plurality of pickets has a W-shaped profile and each of the upper openings is shaped to correspond to the W-shaped profile of each of the plurality of pickets.

13. The security fence of claim 7 wherein each one of the plurality of pickets has a D-shaped profile.

14. The security fence of claim 7 wherein the first and second rail assemblies are each adjustable through a rake angle of −10 degrees through +10 degrees.

15. The security fence of claim 7 wherein each of the first and second rail assemblies further comprises:

a first grommet disposed within one of the bottom openings of the first rail assembly and a second grommet disposed within one of the bottom openings of the second rail assembly, each of the first and second grommets applying a respective force to one of the plurality of pickets.

16. The security fence of claim 15 wherein each of the first and second grommets comprises a resilient tongue portion that applies the respective force to the one of the plurality of pickets.

17. The security fence of claim 7 wherein one of the pair of flanges includes a first cutout proximate the first rail assembly and a second cutout proximate the second rail assembly.

18. A security fence panel, comprising:

a pair of posts, each comprising a pair of flange portions separated by a web portion;

a plurality of rails supported by the pair of posts and disposed vertically spaced apart, each rail comprising a bottom wall and an upper wall, the bottom wall defining a plurality of spaced apart bottom openings, the upper wall defining a plurality of spaced apart upper openings, each of the plurality of rails secured to the web portion of each of the pair of posts by an adjustable bracket, the adjustable bracket comprising a post coupling portion secured to the web portion and an extension portion having a barrel defining a threaded bore mounted at a free end thereof to be positioned within one of the plurality of rails to allow a fastener to be received through the front wall of one of the plurality of rails and into the threaded bore in the barrel allowing a non-perpendicular rake angle between each of the plurality of rails and the pair of posts;

a plurality of pickets spaced apart along the plurality of rails, each picket extending through a respective bottom opening and a respective upper opening of each rail, each picket having a W-shaped profile and each upper opening having a shape corresponding to the W-shaped profile;

a slide lock bar disposed within one of the plurality of rails on a first side of the plurality of pickets and supported by the bottom wall of the one of the plurality of rails, the slide lock bar traversing the plurality of pickets and received by a notch in each picket, wherein engagement of the slide lock bar with the notches enables each picket to be disposed generally vertical independent of the non-perpendicular rake angle; and a cable supported by the web portion of each of the pair of posts and disposed on the second side of the plurality of pickets.

19. The security fence panel of claim 18 further comprising a first grommet disposed within one of the spaced apart bottom openings of a first one of the plurality of rails and a second grommet disposed within one of the spaced apart bottom openings of a second one of the plurality of rails, the first and second grommets applying a force to one of the plurality of pickets.

* * * * *